US010024635B2

(12) United States Patent
Vijay et al.

(10) Patent No.: US 10,024,635 B2
(45) **Date of Patent: *Jul. 17, 2018**

(54) ELECTRO-DISCHARGE SYSTEM FOR NEUTRALIZING LANDMINES

(71) Applicant: VLN Advanced Technologies Inc., Ottawa, Ontario (CA)

(72) Inventors: Mohan Vijay, Gloucester (CA); Emilio Panarella, Ottawa (CA); Meisheng Xu, Ottawa (CA); Wenzhuo Yan, Ottawa (CA); Bruce Daniels, Ottawa (CA); Andrew Tieu, Ottawa (CA)

(73) Assignee: VLN ADVANCED TECHNOLOGIES INC., Ottawa, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/719,726

(22) Filed: Sep. 29, 2017

(65) Prior Publication Data

US 2018/0023929 A1 Jan. 25, 2018

Related U.S. Application Data

(60) Continuation of application No. 15/399,074, filed on Jan. 5, 2017, now Pat. No. 9,829,283, which is a (Continued)

(30) Foreign Application Priority Data

Feb. 24, 2016 (CA) ..... 2921675

(51) Int. Cl.
*F41H 11/16* (2011.01)
*F41H 11/136* (2011.01)

(52) U.S. Cl.
CPC ..... *F41H 11/16* (2013.01); *F41H 11/136* (2013.01)

(58) Field of Classification Search
CPC ..... F41H 11/12; F41H 11/13; F41H 11/136; F41H 11/16; F41H 13/0012;
(Continued)

(56) References Cited

U.S. PATENT DOCUMENTS 2,936,791 A 5/1960 Farrar
3,364,708 A 1/1968 Padberg
(Continued)

FOREIGN PATENT DOCUMENTS

CA 951749 A 7/1974
CA 2477775 A1 7/2016
(Continued)

OTHER PUBLICATIONS

Vijay, M.M. "Pulsed Jets: Fundamentals and Applications", Proc. 5th Pacific Rim International Conference on Waterjet Technology, New Delhi, India, 1998.
(Continued)

*Primary Examiner* — Bret Hayes
(74) *Attorney, Agent, or Firm* — O'Shea Getz P.C.

(57) ABSTRACT

A landmine-neutralization system has a vehicle including a water supply tank and an electrical power supply and an electro-discharge apparatus. The electro-discharge apparatus includes one or more electro-discharge nozzles each having a discharge chamber that has an inlet for receiving water from the water supply tank and an outlet, a first electrode extending into the discharge chamber and being electrically connected to one or more high-voltage capacitors that are connected to, and chargeable by, the electrical power supply, a second electrode proximate to the first electrode to define a gap between the first and second electrodes and a switch to cause the one or more capacitors to discharge across the gap between the electrodes to create a plasma bubble which expands to form a shockwave that escapes through one or
(Continued)

more exit orifices of the one or more nozzles ahead of the plasma bubble to thereby neutralize a landmine.

20 Claims, 21 Drawing Sheets

Related U.S. Application Data division of application No. 15/144,160, filed on May 2, 2016, now Pat. No. 9,739,574.

(58) Field of Classification Search

CPC ..... F41H 13/0037; F41H 13/0043; F41H 13/0093; F41B 9/0046; F41B 9/0087; F41B 9/009; B05B 17/0653

USPC ..... 89/1.13

See application file for complete search history.

(56) References Cited

U.S. PATENT DOCUMENTS

| | | | | |
|---|---|---|---|---|
| 3,647,137 | A | 3/1972 | Naydan et al. | |
| 3,679,007 | A | 7/1972 | O'hare et al. | |
| 4,004,737 | A | 1/1977 | Aker et al. | |
| 4,991,774 | A | 2/1991 | Kelly | |
| 5,106,164 | A | 4/1992 | Kitzinger et al. | |
| 5,120,657 | A | 6/1992 | McCabe et al. | |
| 5,452,639 | A | 9/1995 | Aulenbacher et al. | |
| 5,482,357 | A | 1/1996 | Wint et al. | |
| 5,630,915 | A | 5/1997 | Greene et al. | |
| 5,929,363 | A | 7/1999 | Neff et al. | |
| 5,948,704 | A | 9/1999 | Benjamin et al. | |
| 6,026,135 | A | 2/2000 | McFee et al. | |
| 6,283,555 | B1 | 9/2001 | Arai et al. | |
| 6,343,534 | B1 | 2/2002 | Khanna et al. | |
| 6,455,808 | B1 | 9/2002 | Chung et al. | |
| 6,457,778 | B1 | 10/2002 | Chung et al. | |
| 6,606,932 | B2 | 8/2003 | Goldstein | |
| 6,972,421 | B2 | 12/2005 | Melnychuk et al. | |
| 7,162,943 | B1 | 1/2007 | Reitmeyer et al. | |
| 7,270,195 | B2 | 9/2007 | MacGregor et al. | |
| 7,594,614 | B2 | 9/2009 | Vijay et al. | |
| 7,987,760 | B1 | 8/2011 | Lundquist et al. | |
| 8,063,813 | B1 | 11/2011 | Keller | |
| 8,297,540 | B1 | 10/2012 | Vijay | |
| 8,550,873 | B2 | 10/2013 | Vijay et al. | |
| 8,683,907 | B1 | 4/2014 | Howe et al. | |
| 9,176,504 | B2 | 11/2015 | Chiou et al. | |
| 9,739,574 | B1 * | 8/2017 | Vijay | F41H 11/18 |
| 2005/0262995 | A1 | 12/2005 | Kilkis | |
| 2008/0156219 | A1 | 7/2008 | Voss et al. | |
| 2009/0071910 | A1 | 3/2009 | Ike et al. | |
| 2009/0288550 | A1 | 11/2009 | Willner | |
| 2010/0270347 | A1 * | 10/2010 | Kinzle | B60R 11/00 224/488 |
| 2010/0300335 | A1 | 12/2010 | Zhao et al. | |
| 2011/0120290 | A1 | 5/2011 | Bitar et al. | |
| 2011/0186657 | A1 | 8/2011 | Haviland | |
| 2012/0256013 | A1 | 10/2012 | Giezendanner-Thoben et al. | |
| 2015/0227807 | A1 | 8/2015 | Li | |
| 2016/0207052 | A1 | 7/2016 | Vijay | |

FOREIGN PATENT DOCUMENTS

| | | | |
|---|---|---|---|
| CN | 101780999 | A | 7/2010 |
| WO | WO2011037546 | A2 | 3/2011 |

OTHER PUBLICATIONS

Yutkin, L.A. "Electrohydraulic Effect", Moskva 1955, English Translation by Technical Documents Liaison Office, MCLTD, WP-AFB, Ohio, USA, No. MCL-1207/1-2, Oct. 1961.

Huff C.F. et al. "Investigation into the Effects of an Arc Discharge on a High Velocity Liquid Jet", Sandia Laboratory Report No. 77-1135C, USA 1977.

Vijay et al. "Modeling of Flow Modulation Following the Electrical Discharge in a Nozzle", Proceedings of the 10th American Waterjet Conference, Aug. 1999.

Yan et al. "Application of Ultra-Powerful Pulsed Waterjet Generated by Electrodischarges", Proceedings of the 16th International Conference on Water Jetting, France, Oct. 2002.

Vijay et al. "Numerical Analysis of Pulsed Jet Formation by Electric Discharges in a Nozzle", Proceedings of the 14th International Conference on Jetting Technology, 1998.

Vijay et al. "Electro-Discharge Technique for Producing Powerful Pulsed Waterjets: Potential and Problems", Proceedings of the 13th International Conference on Jetting Technology—Applications and Opportunities, Oct. 1996.

Vijay et al. "Generating Powerful Pulsed Water Jets with Electric Discharges: Fundamental Study", Proceedings of the 9th American Water Jet Conference, Aug. 1997.

VLN Advanced Technologies Inc. "Low-Frequency Forced Pulsed Waterjet-Electrodischarge Technique", Apr. 27, 2016, http://web.archive.org/web/20020405080940/http://www.vln-tech.com/prod2.html.

Llewellyn-Jones, "The Mechanism of Electrode Erosion in Electrical Discharges", Platinum Metals Review, 1963, vol. 7 (2), pp. 58-65.

Office action for U.S. Appl. No. 14/741,101 dated Mar. 29, 2018.

* cited by examiner

ELECTRO-DISCHARGE SYSTEM FOR NEUTRALIZING LANDMINES

CROSS-REFERENCE TO RELATED APPLICATIONS

This application is a continuation application of U.S. patent application Ser. No. 15/399,074 filed Jan. 5, 2017, which is a divisional application of U.S. patent application Ser. No. 15/144,160 filed May 2, 2016, which claims priority to Canadian Patent Appln. No. 2,921,675 filed Feb. 24, 2016, which are hereby incorporated by reference in their entireties.

TECHNICAL FIELD

The present invention relates generally to mining clearing and, in particular, to the neutralization of landmines using fluid jets.

BACKGROUND

Although the exact number of buried landmines is unknown, it is estimated that there are millions of landmines buried in more than seventy countries around the world. Landmines kill or maim over 4000 people every year, often years after hostilities have ceased.

Generally, besides manually clearing landmines, which is slow and hazardous, mechanical means are used for demining. Mechanical tools are designed to deliver sufficient force on the ground to detonate a typical landmine buried about 200 mm underground and to deflect the explosive force. What follows is an overview of some of the main mechanical technologies currently in use today.

Chain flails are by far the most used mechanical means for demining. The chain flail has a central drum rotating at high speed with chains attached to it. The chains carry weights of varying geometries at their free end. As the drum rotates, the end masses strike the ground and deliver a large impact force capable of detonating landmines.

Tiller and roller machines operate on the same principle as the chain flails, with a central drum rotating at high speed that carries hardened chisels or teeth. On plowing through the ground, the rotating teeth strike the ground above the buried landmines, jolting the ground with sufficient force to trigger detonation of the landmines.

There are also hybrid or combination systems that use two or more demining methods in order to increase the neutralization efficiency. These systems are still in the development stage. One uses a set of hydraulic cylinders provided with feet that impact the ground causing detonation of the landmines. The second further crushes any remaining explosive.

These mechanical system suffer from various shortcomings.

Firstly, these mechanical system require a lot of maintenance. For reliable and efficient operation of mechanical demining machines, maintenance and cost are important. Impact tools, such as chain flails and tillers, require frequent maintenance and replacement of parts of worn or damaged parts. Machine downtime is high, and part replacement costs are also high.

Presently available demining machines are severely limited by terrain and weather conditions in a given mine field.

Present demining machines, such as tillers, require powerful engines to drive the tiller drum and the prime mover. This creates problems of mobility, soil compaction, as well as transportation problems.

From the above, it is evident that there remains a need in the industry for more efficient demining techniques that do not give rise to at least some of the issues described above.

SUMMARY

The following presents a simplified summary of some aspects or embodiments of the invention in order to provide a basic understanding of the invention. This summary is not an extensive overview of the invention. It is not intended to identify key or critical elements of the invention or to delineate the scope of the invention. Its sole purpose is to present some embodiments of the invention in a simplified form as a prelude to the more detailed description that is presented later.

The present invention provides a novel electro-discharge system and method for neutralizing landmines. Rather than mechanical, cumbersome, heavy wear and tear technology, it uses fluid mechanical, light weight, long lasting technology of sustainable cost effectiveness. In general, an electro-hydraulic discharge in confined fluid generates a powerful fluid jet through a nozzle. Such fluid jet is directed to the soil where the landmines are buried. The high-pressure fluid jet acts as a mechanical pulsed hammer. Hammering the ground above the land mine causes the landmine to explode.

Accordingly, one inventive aspect of the disclosure is a landmine-neutralization system having a vehicle including a water supply tank and an electrical power supply and an electro-discharge apparatus supported by the vehicle. The electro-discharge apparatus includes one or more electro-discharge nozzles each having a discharge chamber that has an inlet for receiving water from the water supply tank and an outlet, a first electrode extending into the discharge chamber and being electrically connected to one or more high-voltage capacitors that are connected to, and chargeable by, the electrical power supply, a second electrode proximate to the first electrode to define a gap between the first and second electrodes and a switch to cause the one or more capacitors to discharge across the gap between the electrodes to create a plasma bubble which expands to form a shockwave that escapes through one or more exit orifices of the one or more nozzles ahead of the plasma bubble to thereby neutralize a landmine.

Another inventive aspect of the disclosure is a method of neutralizing a landmine. The method entails moving a vehicle having a water supply tank, an electrical power supply and an electro-discharge apparatus in proximity to the landmine, wherein the electro-discharge apparatus comprises one or more electro-discharge nozzles each having a discharge chamber that has an inlet for receiving water from the water supply tank and an outlet and a first electrode extending into the discharge chamber and being electrically connected to one or more high-voltage capacitors that are connected to, and chargeable by, the electrical power supply and a second electrode proximate to the first electrode to define a gap between the first and second electrodes. The method entails causing the one or more capacitors to discharge across the gap between the electrodes to create a plasma bubble which expands to form a shockwave that escapes through one or more exit orifices of the one or more nozzles ahead of the plasma bubble to thereby neutralize a landmine.

BRIEF DESCRIPTION OF THE DRAWINGS

Further features and advantages of the present technology will become apparent from the following detailed description, taken in combination with the appended drawings.

DETAILED DESCRIPTION OF EMBODIMENTS

The embodiments of the present invention provide a system and method for neutralizing landmines using electro-hydraulic jets, i.e. electro-discharge. The system and method can neutralize, destroy, disable or detonate landmines, such as anti-personnel mines, anti-tank mines and improvised explosive devices (IEDs).

Figure 1:
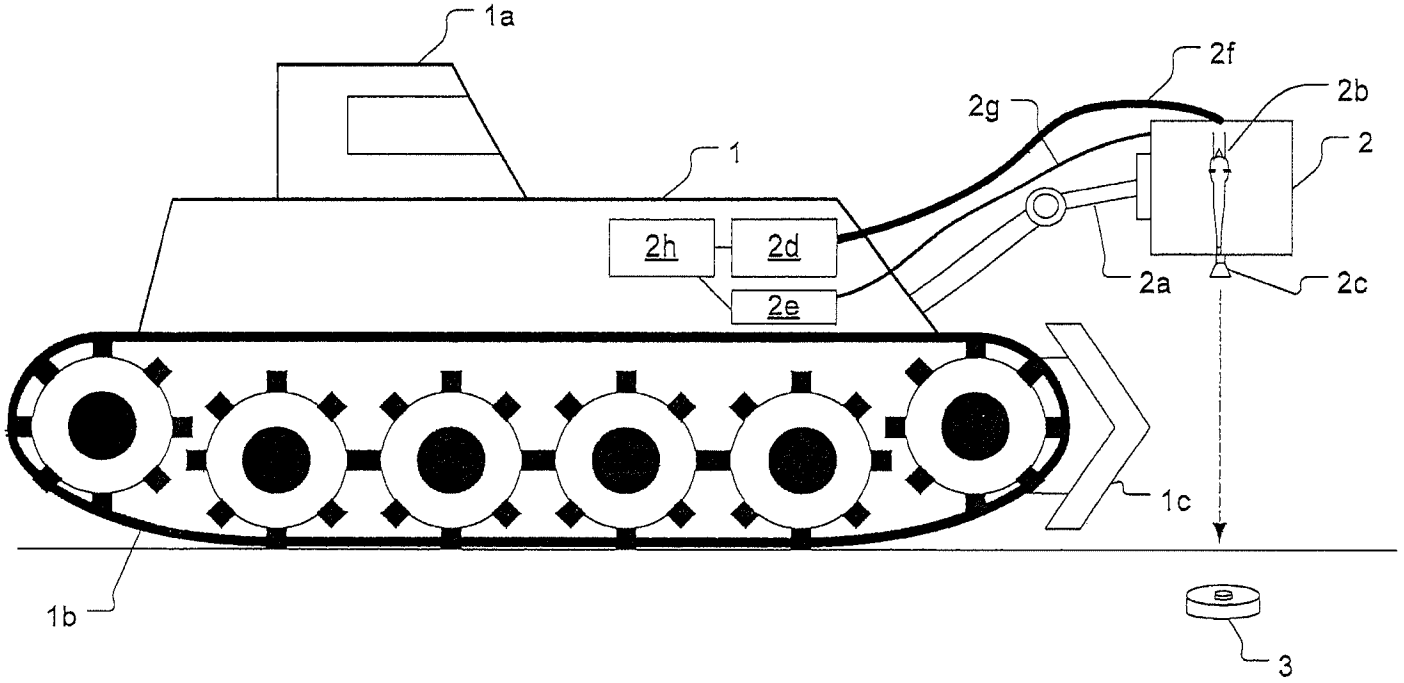
FIG. 1 depicts a mine-neutralization system having an electro-discharge apparatus mounted on a tracked vehicle in accordance with one embodiment of the present invention.

FIG. 1 depicts a landmine-neutralization system in accordance with one embodiment of the present invention. The system includes a landmine-neutralization vehicle denoted by reference numeral 1. The vehicle 1 may have a operator's station, command station, cabin or cockpit 1*a* for manned operation. In another embodiment, the vehicle may be remotely controlled, i.e. an unmanned or robotic device. In the latter embodiment, the vehicle 1 may be directly radio-controlled by a remote user within line of sight or it may be programmed with GPS waypoints or it may be autonomously guided using proximity sensors and a machine vision algorithm implemented by an autonomous navigation processing unit. As depicted in the embodiment of FIG. 1, the vehicle 1 may have a drive track 1*b*, i.e. the vehicle may be a tracked vehicle like a tank. Alternatively, the vehicle 1 may be a wheeled vehicle or a combination of tracks and wheels. The vehicle may have any other suitable type of land mobility mechanisms including, for example, robotic legs, skis, jets, etc. In the illustrated embodiment, the vehicle has a blast shield or deflector shield 1*c* at the front the vehicle to protect the vehicle from detonating landmines.

In the embodiment shown by way of example in FIG. 1, the vehicle 1 has an electro-discharge apparatus 2 supported at a front of the vehicle by a support arm 2*a*. The support arm 2*a* may be a fixed arm or a movable/adjustable arm. The support arm 2*a* may be replaced by any suitable holder, bracket or linkages. The electro-discharge apparatus 2 includes one or more electro-discharge nozzles 2*b* that can be filled (or partially filled) with water or other suitable fluid. Positive and negative electrodes 2*b*.1 and 2*b*.2 in each electro-discharge nozzle electrically break down the water to form a plasma bubble which exits through one or more exit orifices 2*c* in the chamber. Each nozzle 2*b* which is shown schematically in FIGS. 1-9 includes a pair of adjacent electrodes 2*b*.1 and 2*b*.2, one positive and the other negative between which an arc or spark forms to form the plasma jet. The discharge apparatus 2 may contain one nozzle 2*b* or a plurality of nozzles 2*b*. Various nozzle designs will be described below.

The vehicle 1 includes a water supply tank 2*d* and an electrical power supply 2*c* which may include a capacitor bank having one or more capacitors ("condensers"), super-capacitors, or ultracapacitors. The electrical power supply may optionally include batteries. The capacitors and batteries may be charged and recharged by an alternator or generator in the vehicle. A water supply hose 2*f* supplies water to the electro-discharge nozzle(s) inside the electro-discharge apparatus from the water supply tank 2*d* in the vehicle. The electrical power supply 2*e* is connected to the electrodes 2*b*.1, 2*b*.2 of each nozzle via an electrical supply cable 2*g*. Each nozzle has a nozzle body that defines an interior discharge chamber that is filled, or partially filled, with water or other suitable fluid. The electrodes 2*b*.1, 2*b*.2 are disposed in proximity to each other inside the discharge chamber.

The vehicle 1 may include, as shown in FIG. 1, a controller or processor 2*h* (i.e. a microcontroller, microprocessor or centralized processing unit) that controls the filling and refilling of the discharge chamber inside each nozzle and also controls the supply of electrical current to the electrodes of the electro-discharge apparatus 2. When the electro-discharge apparatus 2 is fired, a plasma jet is generated which blasts the ground with a shockwave that detonates or destroys (neutralizes) a buried landmine 3. As will be described in greater detail below, the electro-discharge apparatus 2 receives water (or other suitable fluid) from the water supply tank 2*d*, receives an electrical current from high-voltage capacitors to cause a discharge or spark across a gap between positive and negative electrodes to create a plasma bubble which expands to form a shockwave that escapes from the nozzle ahead of the plasma bubble to thereby neutralize a landmine 3 buried in the ground.

Figure 2:
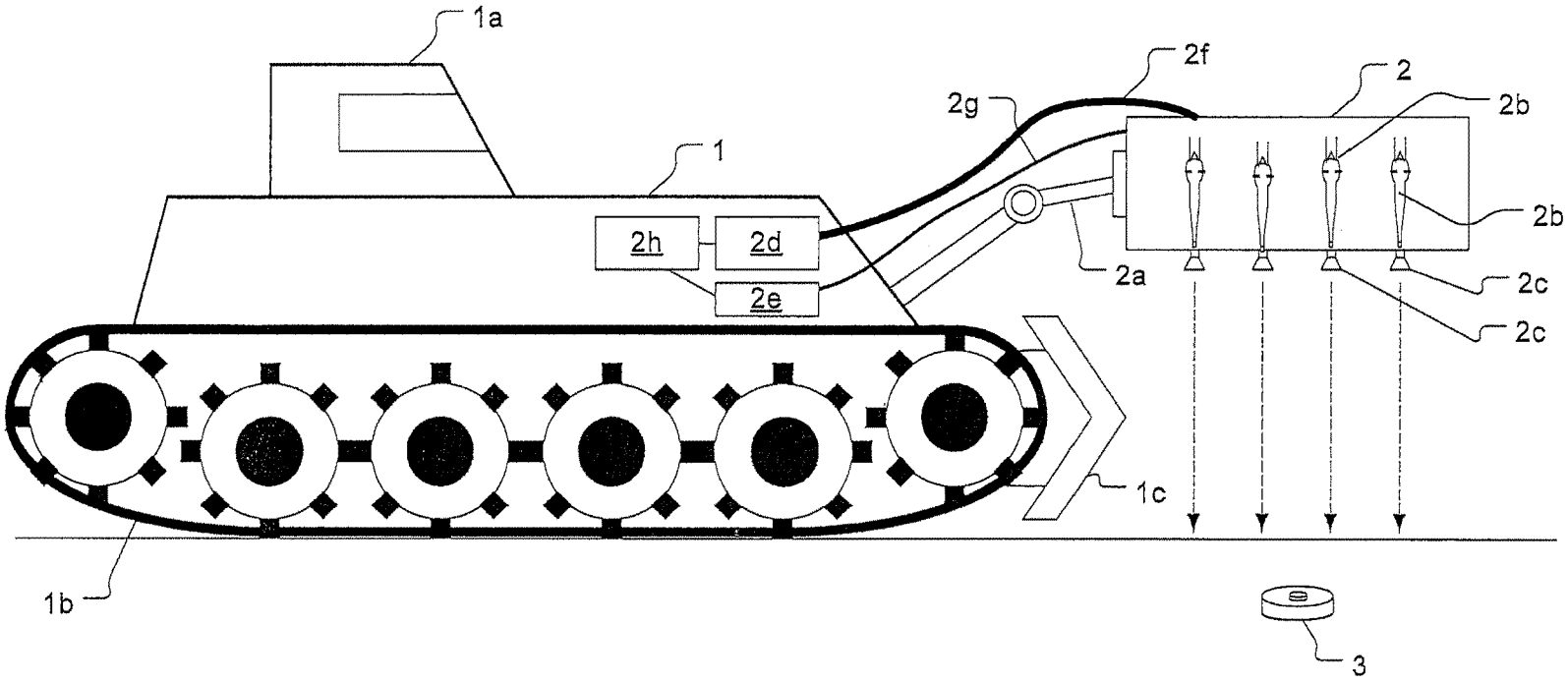
FIG. 2 depicts another embodiment of the system shown in FIG. 1 in which the electro-discharge apparatus has multiple orifices.

In the embodiment depicted in FIG. 2, the electro-discharge apparatus 2 may have a plurality of nozzles 2*b* and a plurality of exit orifices 2*c*. The ratio of nozzles to orifices may be 1:1 (each being a single orifice nozzle) although in other embodiments the nozzle may be multi-orifice nozzles so that the ratio is not 1:1.

Figure 3:
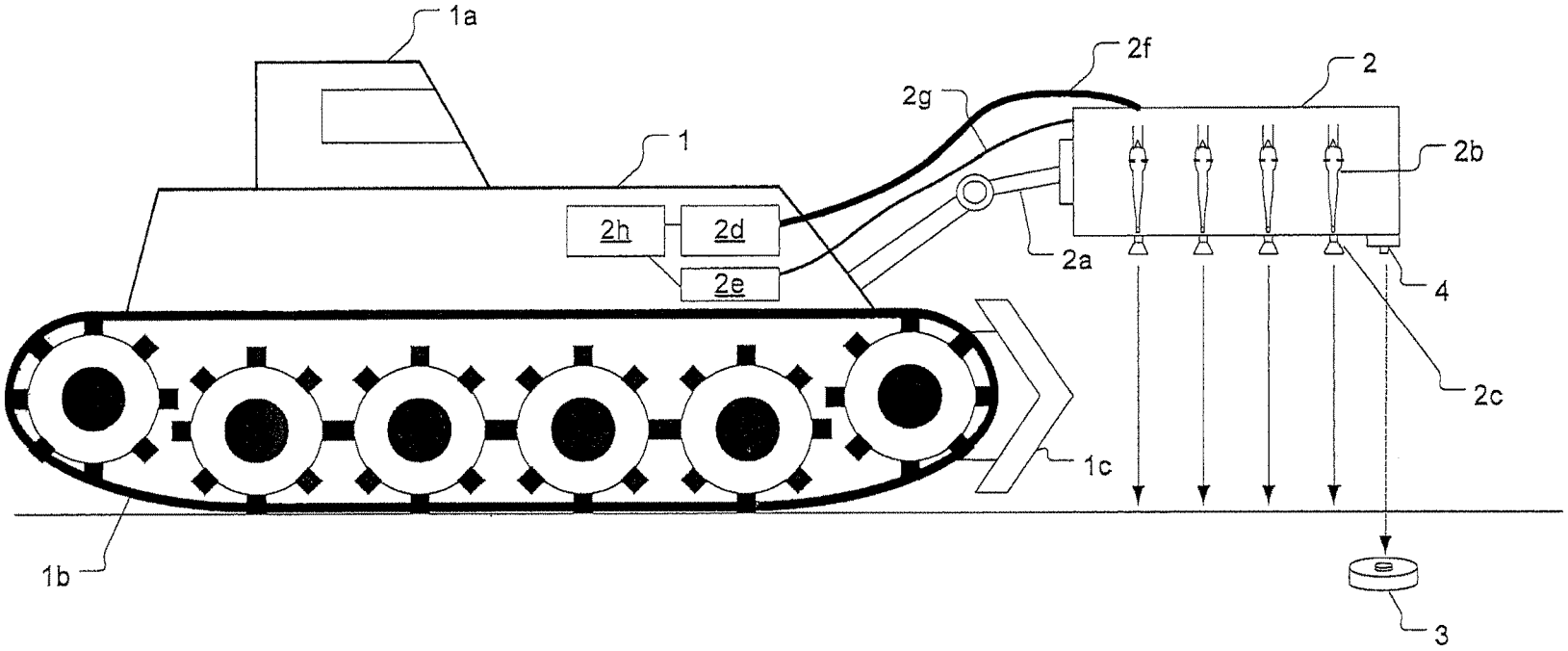
FIG. 3 depicts another embodiment of the system shown in FIG. 2 in which a mine-detecting sensor is mounted to the electro-discharge apparatus.
Figure 4:
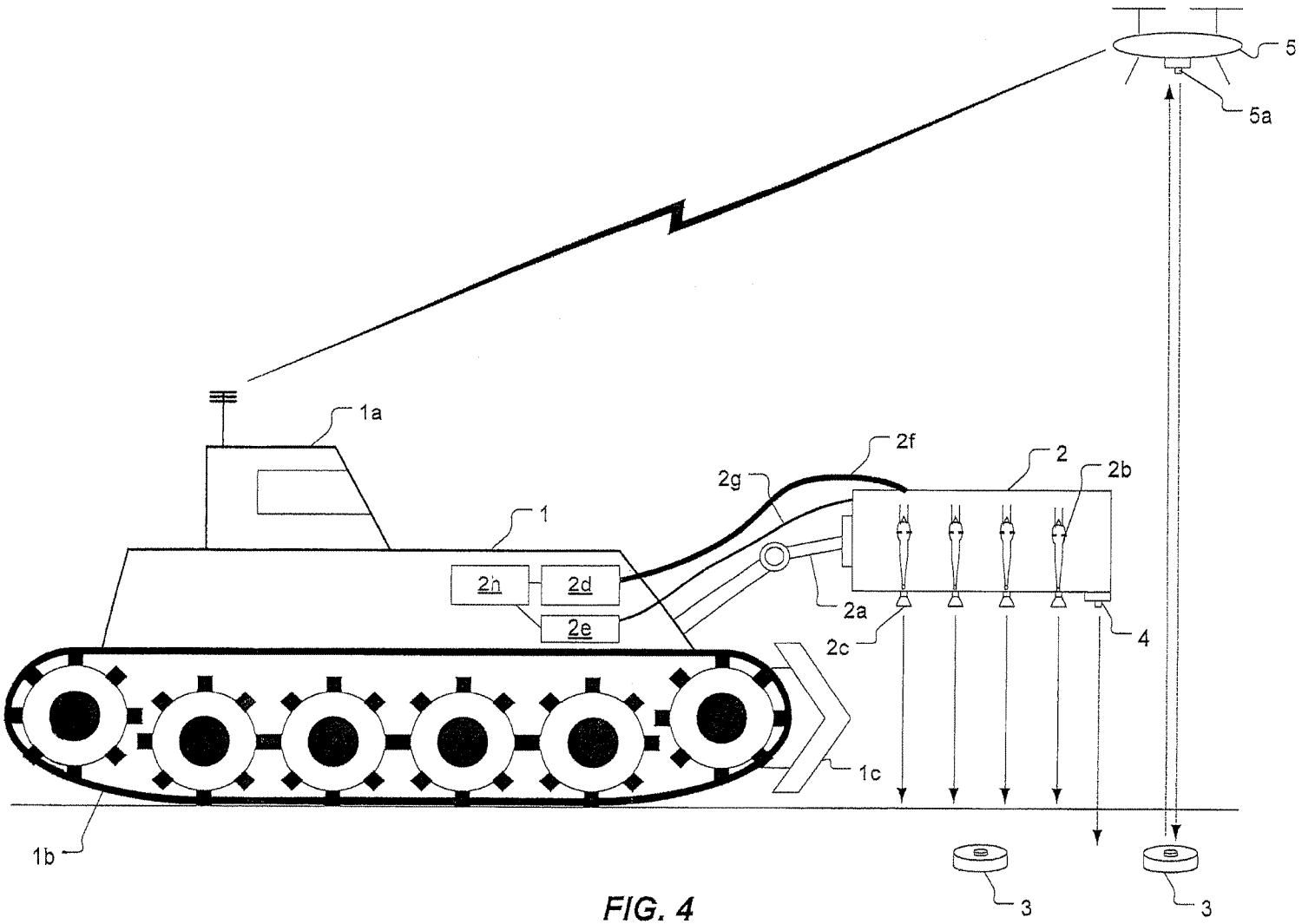
FIG. 4 depicts another embodiment of the system shown in FIG. 3 further including a drone or other airborne vehicle capable of detecting buried landmines.

In the embodiment depicted in FIG. 3, the system 1 includes a landmine detector 4 or sensor. This landmine detector or sensor may be a ground-penetrator radar, metal detector or a combination thereof. The system may optionally include a drone 5 or unmanned aerial vehicle having an airborne landmine detector 5*a* as depicted by way of example in FIG. 4. The drone may be a fixed-wing aircraft, a helicopter, a quadcopter, etc. In one embodiment, the drone may be radio-controlled or programmed for autonomous or semi-autonomous flight to fly or hover forward of the advancing vehicle 1. In one embodiment, the drone is programmed to fly over a predetermined area to seek buried landmines. The drone may be configured to automatically relay mine-detection data to the vehicle. The vehicle may be configured to travel automatically to the location of a detected landmine in response to a landmine detection event.

Figure 5:
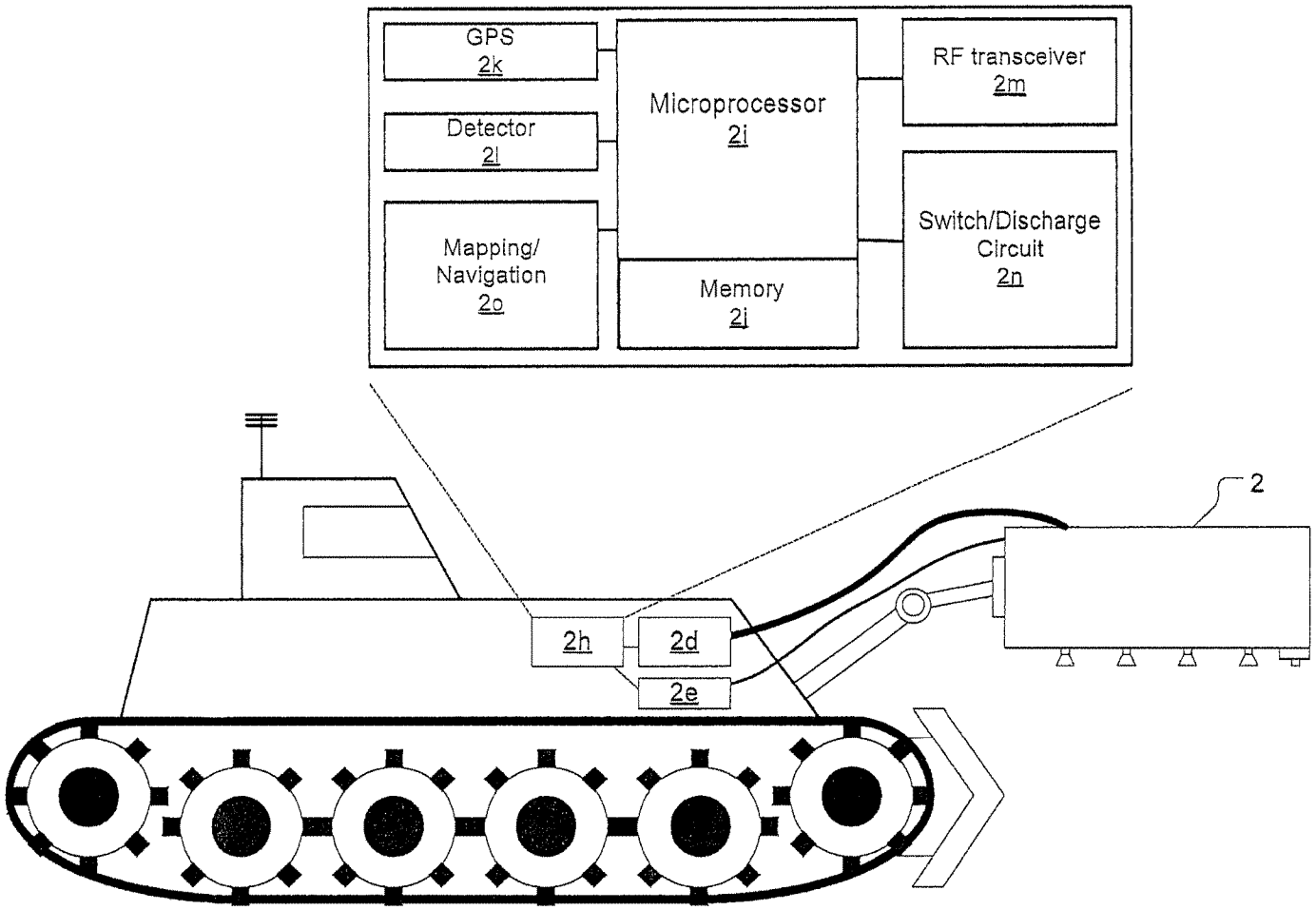
FIG. 5 schematically depicts components of the system of FIGS. 1-4.

Details of the controller 2*h* are presented by way of example in FIG. 5. The controller 2*h* may include a microprocessor 2*i*, e.g. a CPU, dual-core CPU, quad-core CPU or equivalent and a memory 2*j*, which may include RAM and ROM. The controller 2*h* may include a Global Positioning System (GPS) chip 2*k*. The controller 2*h* may include a mine detector module 21, which may include an analog-to-digital converter for converting raw mine-detection signals into data and a digital signal processing module for processing the data. The controller 2*h* may include one or more RF transceivers 2*m* for communicating with a remote operator, headquarters, a mine-seeking drone or other vehicles participating in a mine-sweeping operation. The controller 2*h* may include a switch/discharge circuit 2*n* (or "switch") for causing the capacitor(s) to discharge in response to a signal from the microprocessor 2*i*. The controller 2*h* may include a mapping/navigation unit 2*o* for creating maps of areas that have been swept for mines, indicating places where mines have been detected and neutralized, and enabling a user to plot or program a course for the vehicle and/or its mine-seeking drone by drawing an area on a digital map displayed on a display screen.

Figure 6:
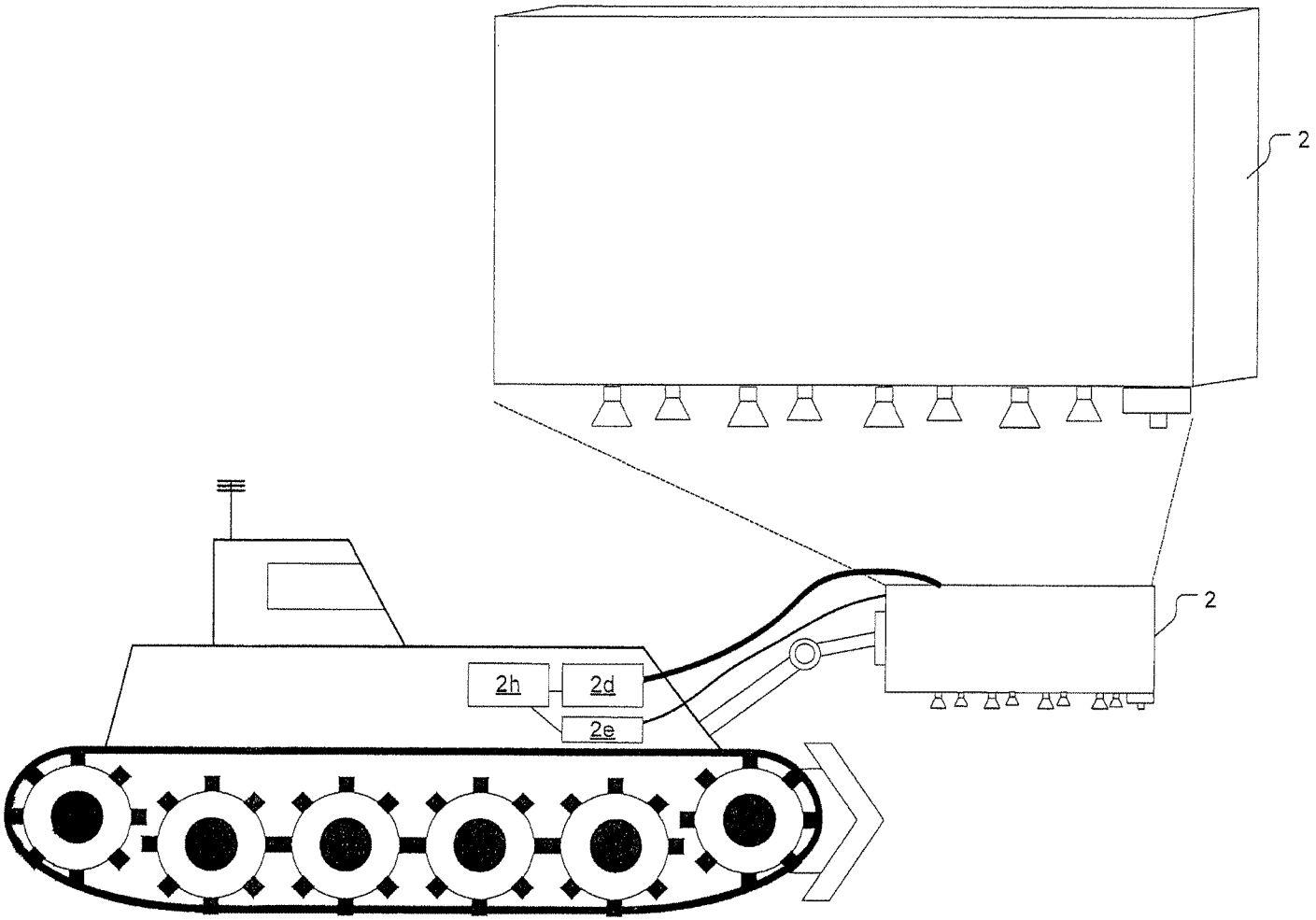
FIG. 6 depicts a multiple-orifice electro-discharge apparatus.
Figure 7:
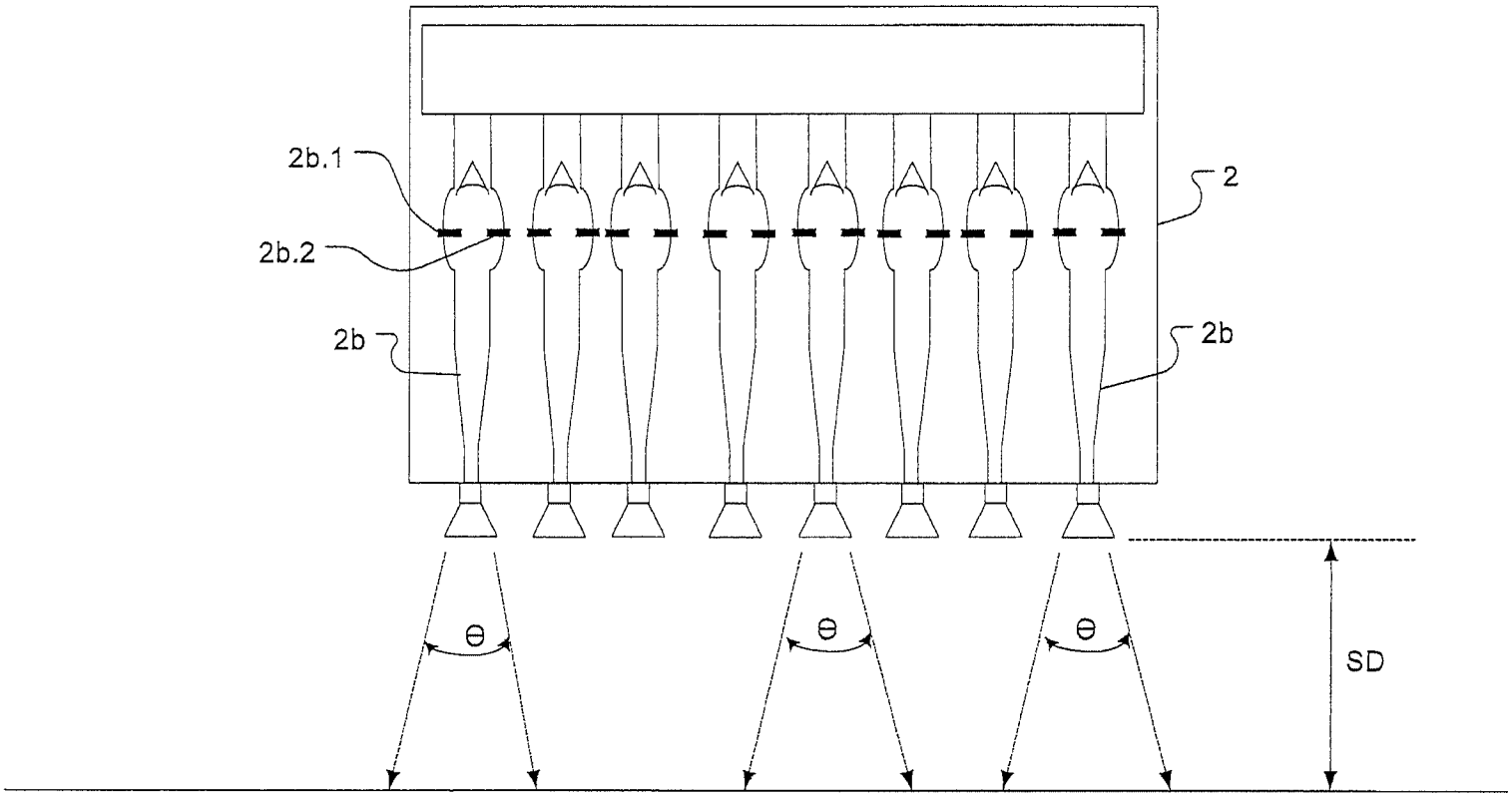
FIG. 7 depicts another example of a multiple-orifice electro-discharge apparatus.

FIG. 6 illustrates a multi-orifice electro-discharge apparatus 2 which there are two rows of four electrodes and two rows of four orifices. FIG. 7 shows that each jet may be characterized by an angle of the jet θ and its standoff distance (SD). In one example embodiment, the angle of the jet θ is 30 degrees although other angles may be utilized. In some embodiments, the standoff distance is adjustable by varying the height above ground of the electro-discharge apparatus 2. A ground-sensing device, such as ultrasound or SONAR, may be used to measure a distance to the ground. The controller may automatically adjust the standoff distance based on the measure distance to the ground to optimize the standoff distance. In some embodiments, the switch 2*n* may cause only one of the plurality of electrodes to discharge, a subset to discharge or all of them to discharge sequentially or simultaneously.

Figure 8:
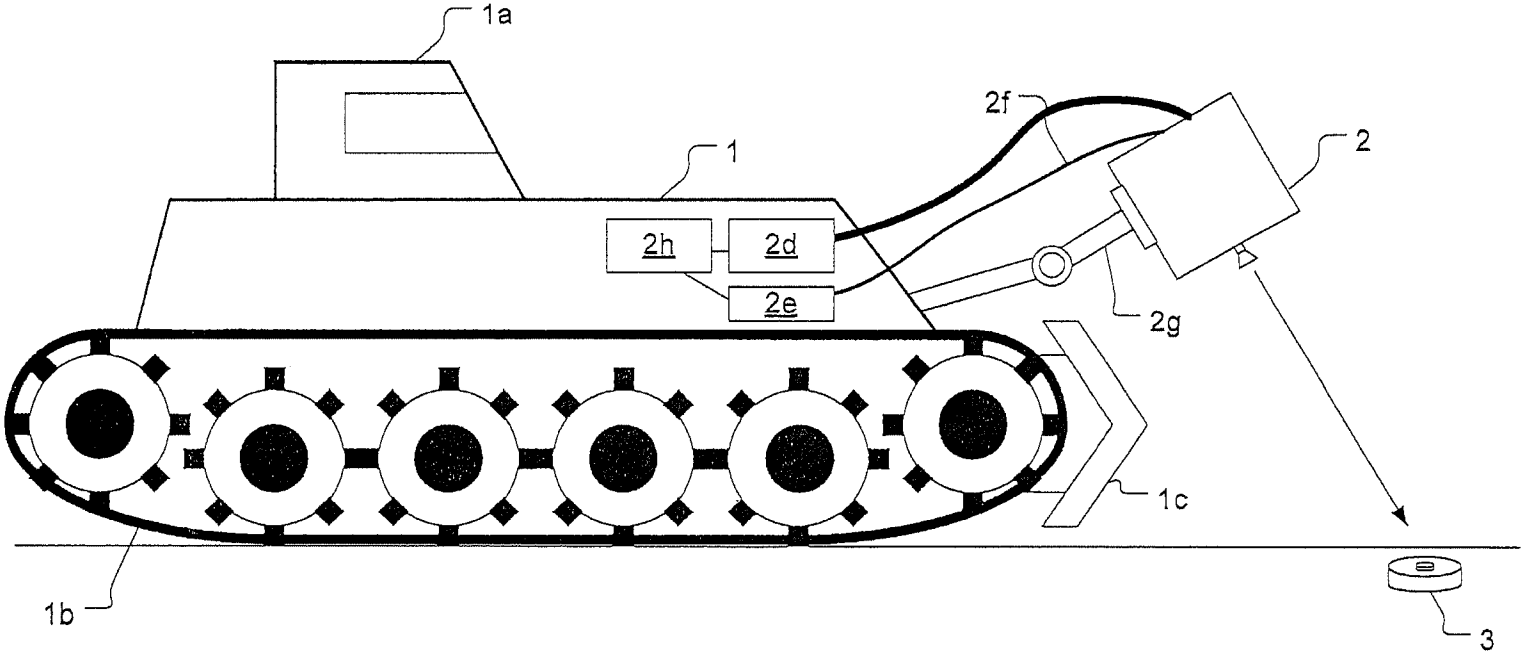
FIG. 8 depicts another embodiment in which the electro-discharge apparatus is adjustable in posture.

In the embodiment depicted by way of example in FIG. 8, the electro-discharge apparatus 2 may be tilted or angled to direct the fluid jet at an angle to the ground.

Figure 9:
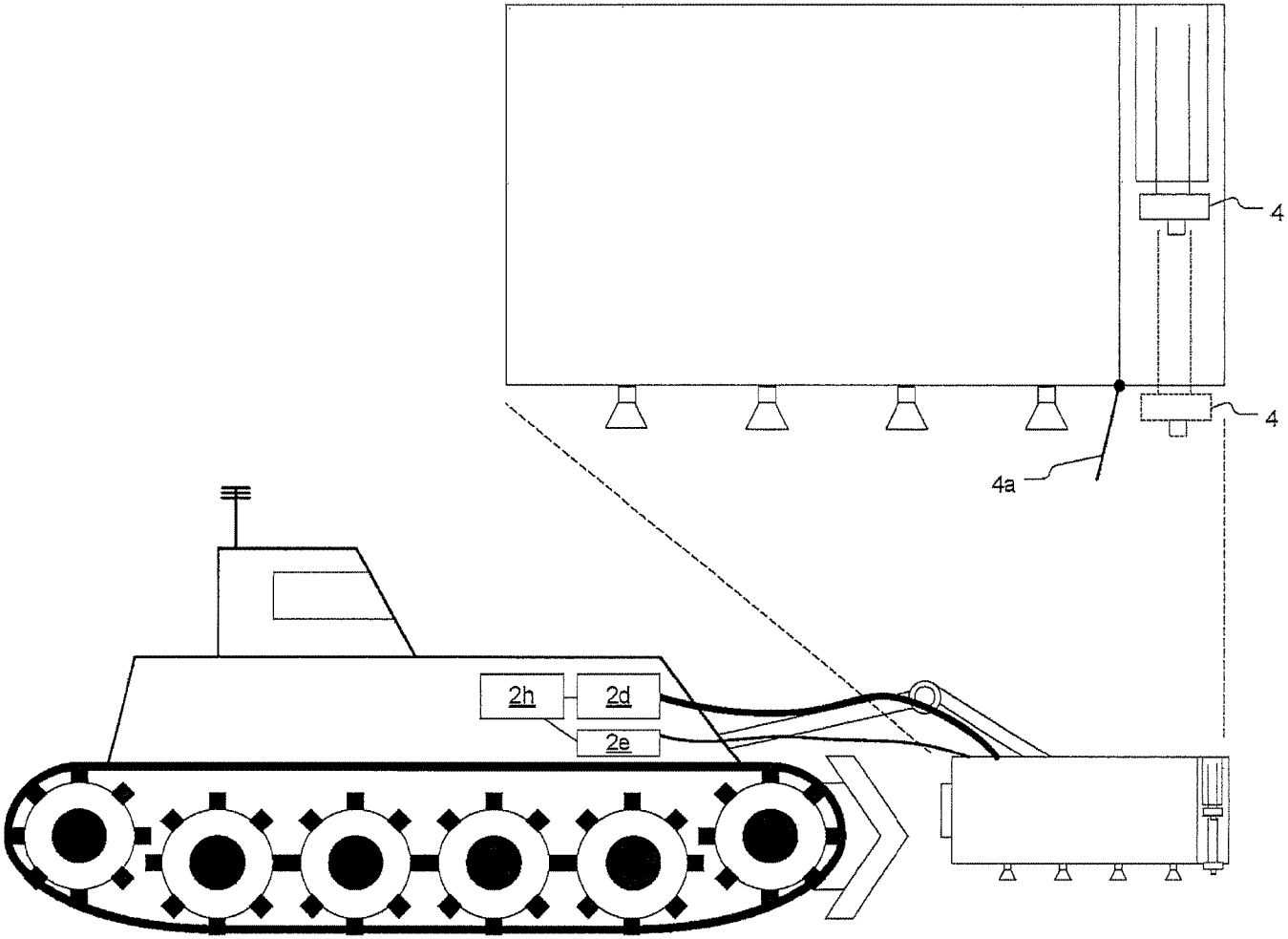
FIG. 9 depicts an electro-discharge apparatus having a retractable sensor and a blast door.

FIG. 9 depicts an embodiment in which the mine-detecting sensor 4 is retractable within the apparatus 2 to protect the sensor 4 from the blast. The sensor 4 may be extendable on an actuator such as a pneumatic, hydraulic or electrical actuator. A pivoting blast door 4*a* may open and close to enable the sensor to extend and retract. The blast door 4*a* protects the sensor from the blast. In one embodiment, there is a door sensor that senses whether the blast door is closed before the switch 2*n* can be turned on as a precaution to prevent damage to the sensor. In a variant, triggering the switch 2*n* causes the blast door 4*a* to close as a prelude to discharging the capacitor bank.

In other embodiments, the landmine-neutralization system may be incorporated or disposed on or within a towable cart, pull-cart, man-portable backpack, helicopter, drone or autonomous robotic land vehicle. In the latter example, the autonomous robotic land vehicle may have a processor implementing an artificial intelligence or it may be a GPS-programmable controller that can control the vehicle in order to travel a predetermined route or circuit. The autonomous robotic land vehicle can be programmed to automatically trigger the electro-discharge in response to detecting a landmine.

For the purposes of this specification, references to landmines (or mines) encompasses any other explosive device that is intended to be buried in the ground, including for example improved explosive devices (IEDs).

The electro-discharge apparatus 2 described above may be replaced by an electro-discharge nozzle according to one of the embodiments described below.

Figure 10:
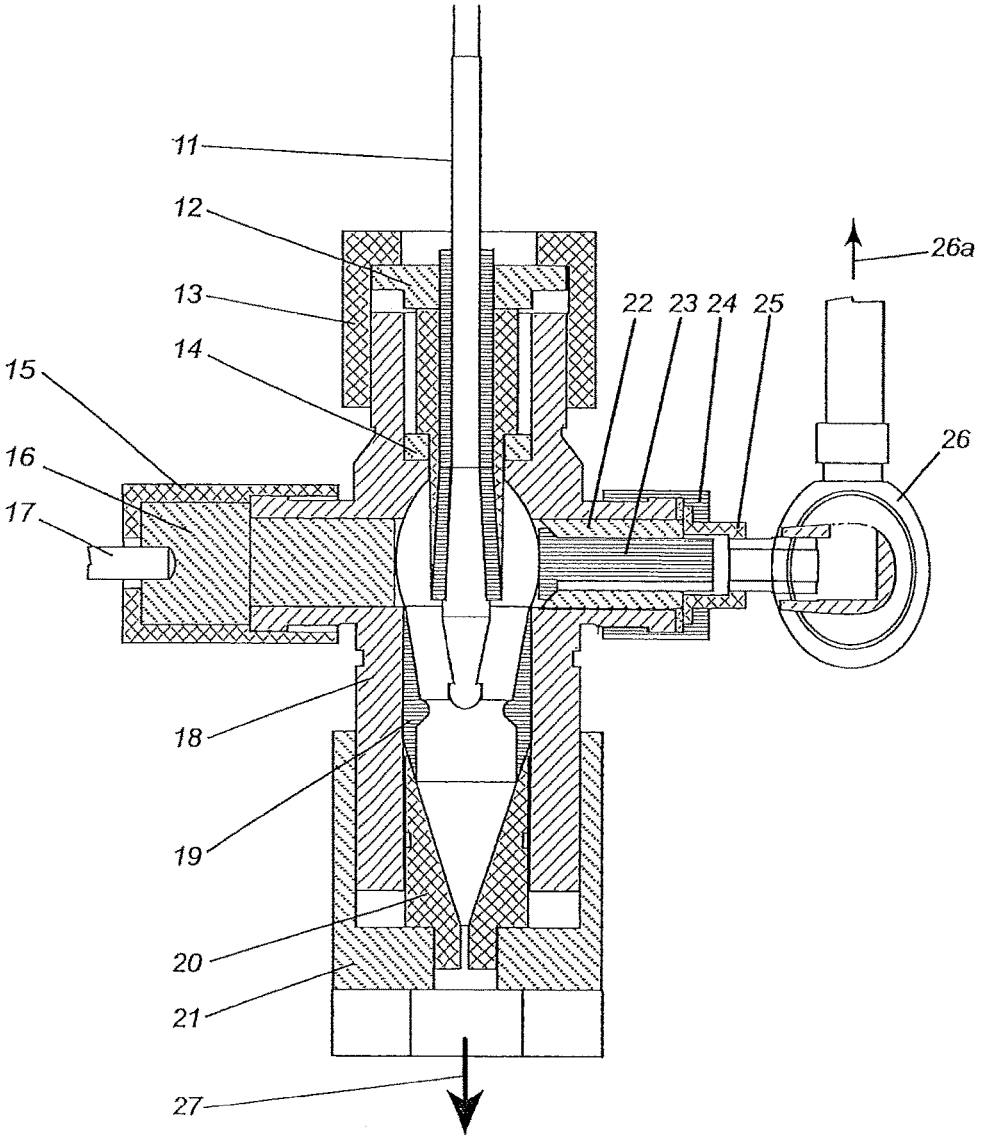
FIG. 10 depicts a nozzle-electrode configuration for producing long or short plasma channels that may be used for the electro-discharge apparatus.

In one embodiment of a nozzle which shown in FIG. 10, an insulated electrode 11 is located in an axial direction of a nozzle body 18. The nozzle body 18 is composed of a lower housing 21 and a curved, hemi-spherical upper housing 13 (although this may have another shape). The nozzle body 18 can be connected to a high-pressure pump through an inlet indicated by the 90° elbow 26 or filled with quiescent water using a check valve 23. Breakdown of water to form a plasma bubble after the discharge occurs due to the high-intensity electric field between the tip of the high-voltage central electrode 11 and the tip of grounded metallic ring 19. The electric field strength E is determined by V/ι, where V is the magnitude of the applied voltage and ι=gap width, that is, the distance between the tips of the electrodes. Depending upon the physical property of water, e.g. conductive, nonconductive, etc., the electric field strength required for breakdown is of the order of 3.4 kV/mm. By varying the position of the central electrode 11 and/or the grounded metallic ring 19 the required electric field for breakdown of water can be obtained. In the case of flowing water, generally depending upon the pressure, a wake forms downstream of the central electrode 11. The wake is a bubble composed partially of water vapor, which is actually vaporous cavitation. In this case, the strength of the electric field could be of the order of 1 kV/mm as the water vapor breaks down much more readily to form the plasma than water. In this embodiment, the apparatus also includes spacing rings 12 and 14 to vary the gap width (ι), the metal plug 16 to which a pressure sensor (not shown in the figure) could be attached to measure the pressure exerted by the plasma, a metallic rod 17 to connect the ground electrode to the cables leading to the capacitor, nozzle insert 20 having various diameter orifices (0.5 mm≤$d_o$≤19 mm), check valve body 22, nut 24 for fastening the water inlet component to the nozzle body 18, water inlet part 25, and the 90° elbow 26 for water inlet tube. The inlet tube is connected to a water pump by a hose 26*a* (which is not depicted in the figure). The tube can also be connected to a water bottle to provide quiescent water in the nozzle chamber. After each discharge, the chamber can be refilled by means of the check valve. Due to the small diameter orifices, the shock and the cavitation bubble most likely decay right inside the nozzle.

Figure 11:
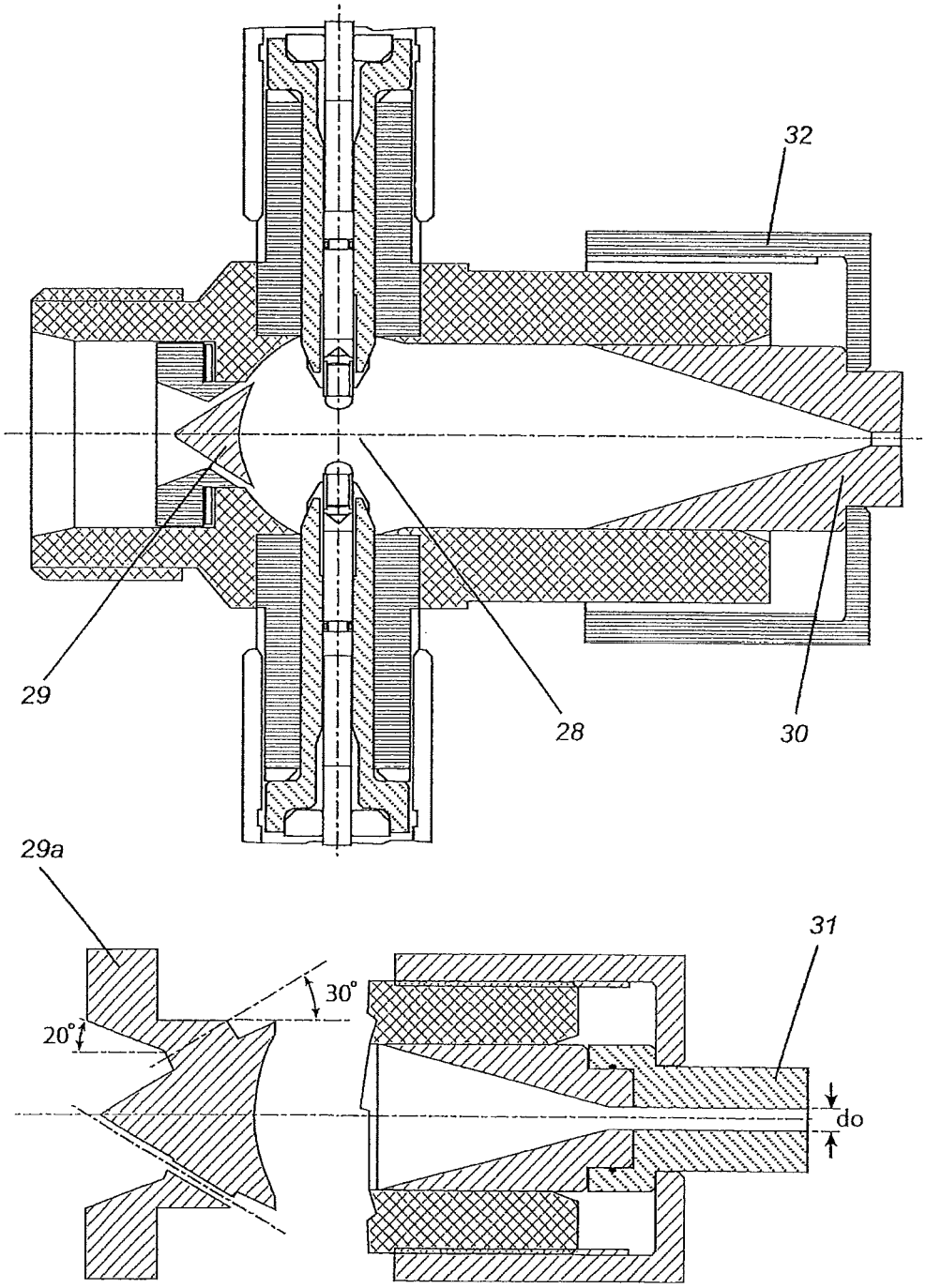
FIG. 11 is an embodiment showing the details of the electrode and a reflector to reflect the shockwave generated by the discharge.

FIG. 11 shows a nozzle configuration with the electrodes mounted in the transverse direction. By suitable design of the electrode assembly, discussed in a subsequent section, the gap width (ι) 28 can be varied from 1 mm to almost 30 mm. The configuration also shows the reflector 29 which also functions as a check valve momentarily stopping the flow of water 33 in the nozzle chamber until the next discharge. The details of one specific embodiment of the reflector are shown in 29*a*. The orifice diameters ($d_o$) in the nozzle insert 30 depend on the flow rates of water and can vary from 0.5 mm to 19 mm. The length of nozzle exit (L3) can be varied by attaching the extensions 31 with the nut 32. For short lengths, L3≈$d_o$, and large orifice diameters (≥6 mm), the shockwave emerging from the electrode will have a spherical shape. As the lengths are increased, the wave will emerge as a plane wave. Furthermore, confinement of the plasma bubble in the cylindrical sections of the extensions generates a powerful pulse of water.

Figure 12:
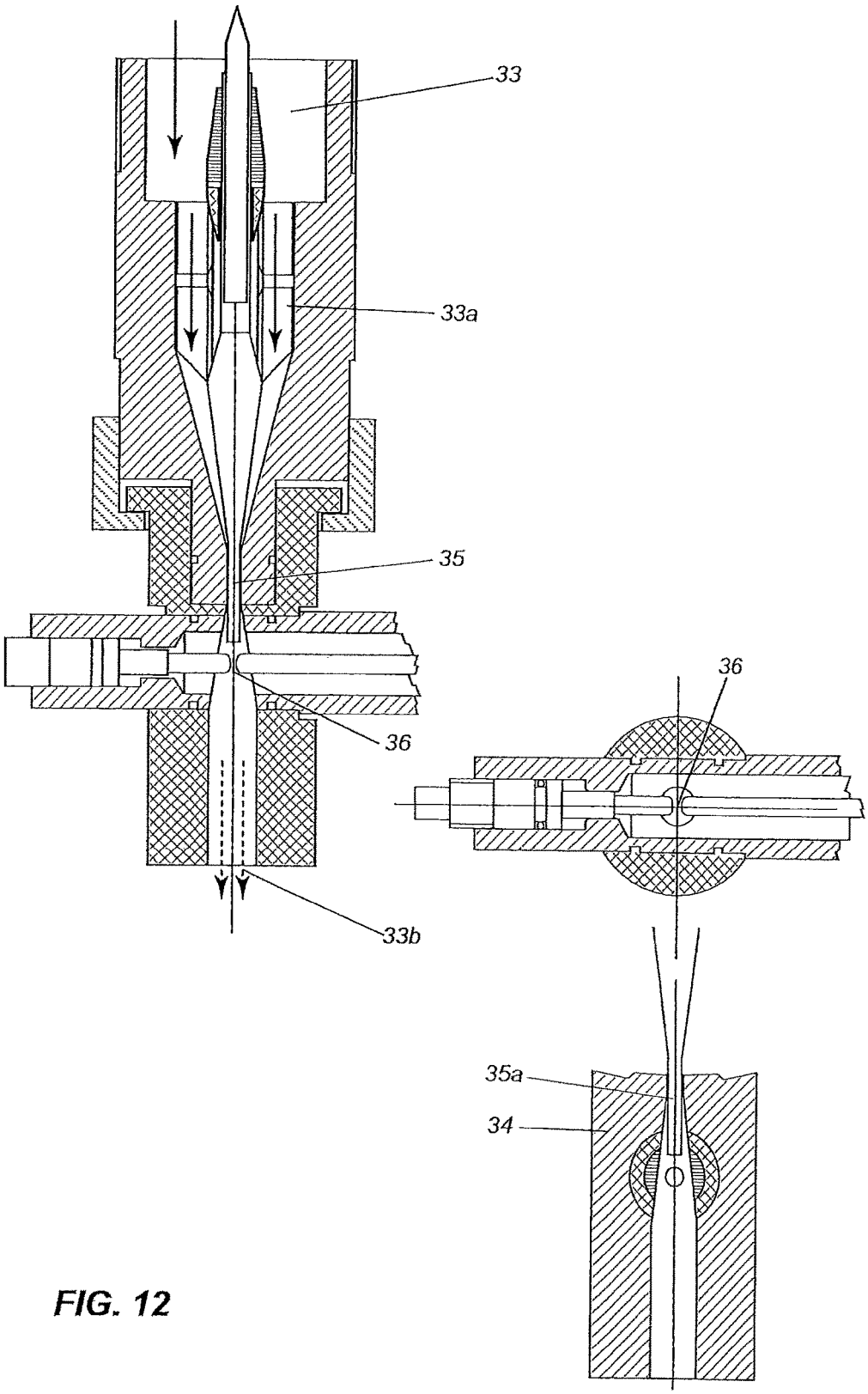
FIG. 12 is yet another embodiment showing transverse electrodes with the reflector.

FIG. 12 shows an embodiment to modulate a high-speed water stream, that is, a waterjet, to augment its cutting or fragmenting performance. Water from the pump enters through the inlet 33, flows through the annulus 35*a*, indicated by the dotted arrows 33*a*, between the centre body 35 (which may be a microtip of an ultrasonic transducer driven by an ultrasonic generator) and the nozzle insert 34. The centre body, which functions as a reflector, separates the flow and forms a wake (a low-pressure zone) in the gap 36 of the electrodes. In turbulent flow the wake is a stagnant zone composed of a mixture of dissolved gases, water vapor and quiescent water. With the rapid discharge of electrical energy, this mixture breaks down quite readily to form the plasma which travels in the diverging section downstream of the electrodes and in the cylindrical section 34 of the nozzle. The dimension of the annulus depends on the pressure and the flow rate required for a given application. As an example, if the required flow rate is of the order of 15 usgpm at a pressure of 15 kpsi, and for the size of 0.166 in of the cylindrical section of centre body 34, the dimension of the annulus is of the order of 0.006 in. As stated in section 10, since the gap width (ι) is of the order of 2 mm, the discharge produces spherical shock waves and plasma bubbles. In the long cylindrical section 34, the shock waves are transformed into plane waves before impacting the target. The plasma bubbles are confined within the annular flow of water, shown by the dotted arrows 33*b* to implode on the target and generate very high impact pressures enhancing the fragmentation ability of the continuous waterjet.

Figure 13:
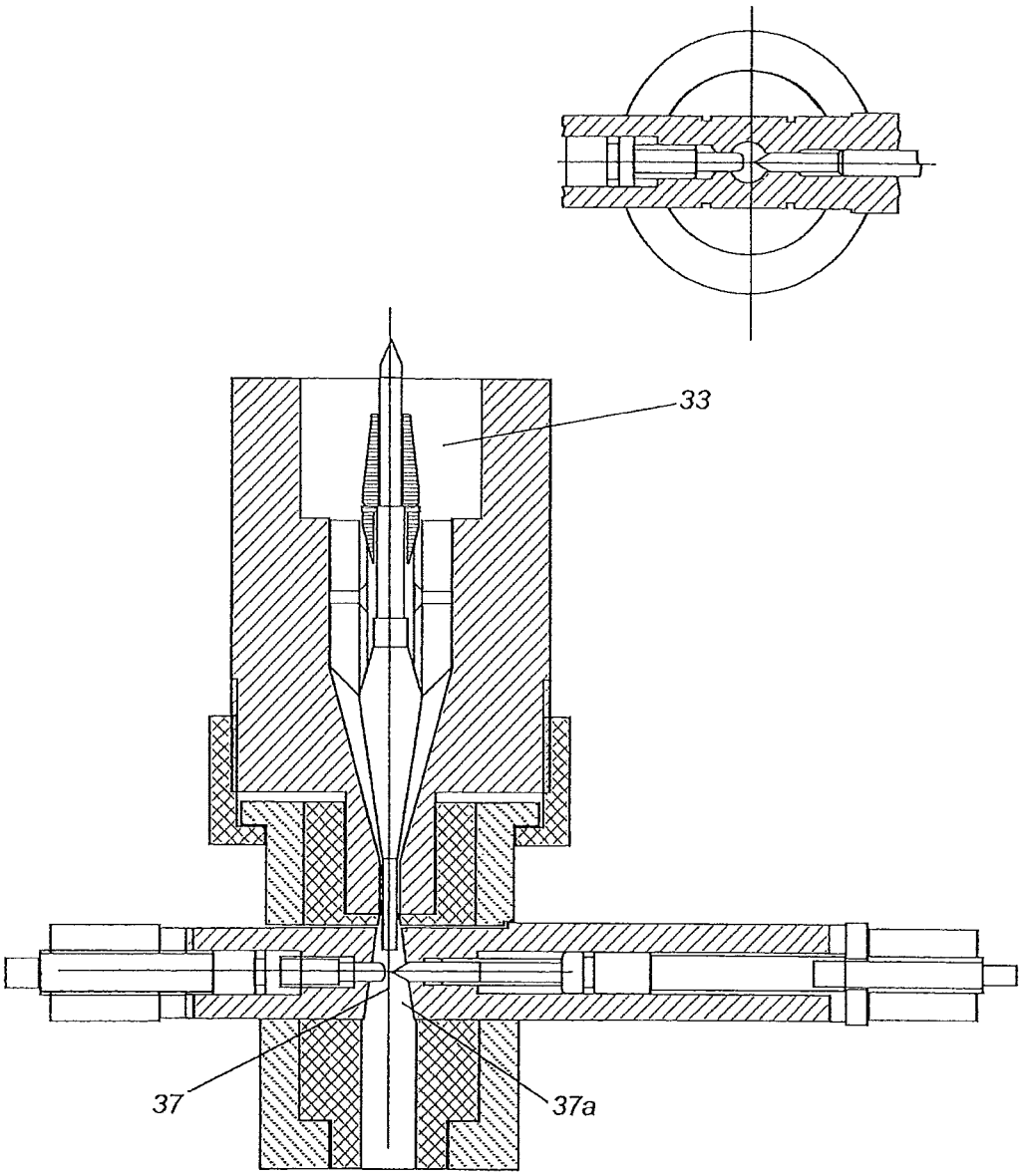
FIG. 13 is the same as FIG. 12, except the tips of the electrodes are planar and pointed to enhance the strength of the electric field.

FIG. 13 shows another embodiment which is similar to the one illustrated in FIG. 12, except that the tip of the grounded electrode is a plane 37 and the tip of the high-voltage electrode 37*a* is pointed like a needle. This configuration of the electrodes focuses the electric field strength for breaking down the water and intensifying the strength of the shock wave and the plasma bubble.

Figure 14:
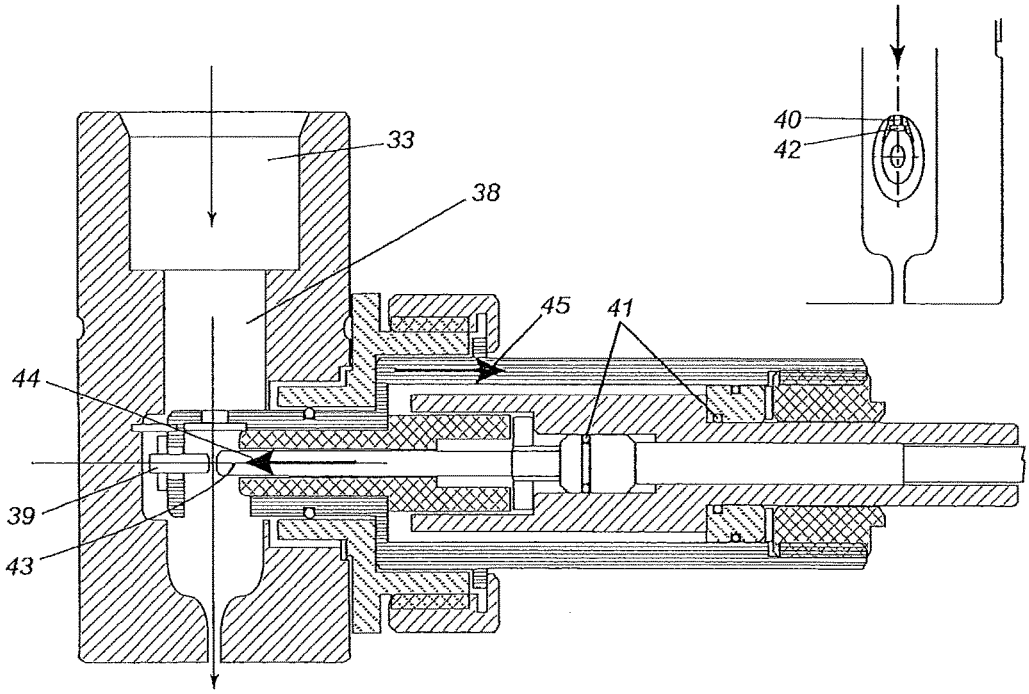
FIG. 14 is an embodiment showing how the ground and high-voltage electrodes are assembled as a single unit for sliding into and out of the nozzle.

FIG. 14 is another embodiment for modulating a high-speed waterjet with the electro-discharge technique. The nozzle body is composed of a large inlet section 38 to maintain a fairly low speed of water delivered by the pump 33, equivalent to quiescent water. The ground electrode 39 and the high-voltage electrode 43 are assembled as one unit (a detachable electrode assembly) so that it can be easily slid into and out of the nozzle body. In addition to the advantage of easy alignment, the current induced by the rapid discharge indicated by the dotted arrow 44 and flowing through the reflector 40 mounted on the ground electrode indicated by the dotted arrow 45 generates a high-intensity electromagnetic force which will provide additional force to increase the speed of the plasma bubble moving towards the nozzle exit. As the electrode assembly can be slid in and out of the nozzle body, the condition of the tips of the electrodes can be readily examined without disconnecting the electrical cables connected to the capacitor bank 1 (FIG. 1). The easily replaceable reflector 40 enhances the strength of the shockwaves as described in FIG. 4. The discharge zone 42 can be easily controlled by varying the position of the ground electrode 39.

Figure 15:
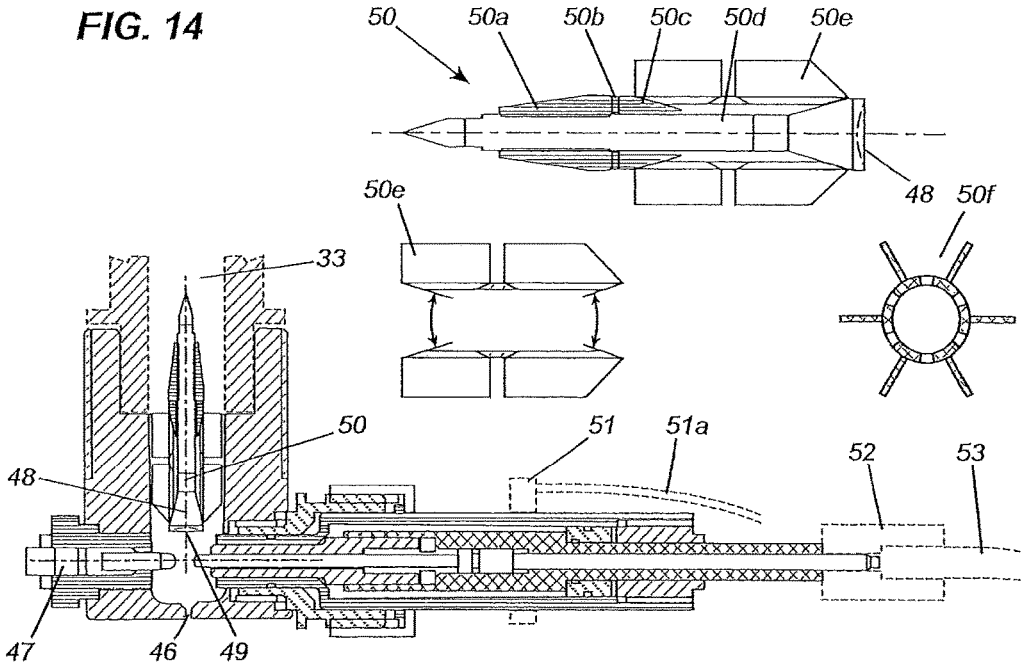
FIG. 15 is an embodiment in which the position of the reflector with respect to the electrodes can be varied.

FIG. 15 is an embodiment similar to the one shown in FIG. 12 except that the space surrounding the electrodes 49 can be varied to reduce the speed of water in the discharge zone, that is, the gap between the electrodes. It is also meant for fairly low pump pressure (≤5 kpsi) and moderate flow of water (≥10 usgal/min). In the embodiment depicted in this figure, the apparatus generates pulses of water by the imploding plasma bubble slightly upstream (≈2$d_o$) of the nozzle exit 46. In the illustrated embodiment, the apparatus includes a large water inlet 33 and a centre body 50 which also functions as a reflector 48. In addition to functioning as a reflector, it also incorporates a flow straightener 50*e* with vanes 50*f* to smoothen the flow, that is, to reduce the level of turbulence in the flow. In all the embodiments disclosed herein, it is important to reduce the level of turbulence in order to eliminate undesirable sparking (formation of an electric arc), also called tracking from the high-voltage electrode to another part of the nozzle other than the ground electrode. The straightener is mounted on a threaded mandrel 50*d*, fabricated from type-303 stainless steel or similar material. The mandrel 50*d* is held in place by the conical nut 50*a* fabricated from high-strength bronze or similar material and the cone 50*c* with a flat washer 50*b* to absorb the load induced by the shocks. The tip of the mandrel 48 has a shape of a concave hemisphere although in variants it could be parabolic or another suitable shape, to focus and propel the shocks towards the nozzle exit 46. The discharge zone downstream of the reflector 49 can be controlled by varying the position of the ground electrode tip 47. The bus bar 51 fabricated from brass or similar material connects the ground cables 51*a* to the capacitor bank and the connector 52 also made of brass or copper or similar material connects the high-voltage cables 53 to the capacitor bank. The number of shielded cables used (which may be ≥10) depends on the transient discharge current generated by the energy discharged from the capacitor bank.

Figure 16:
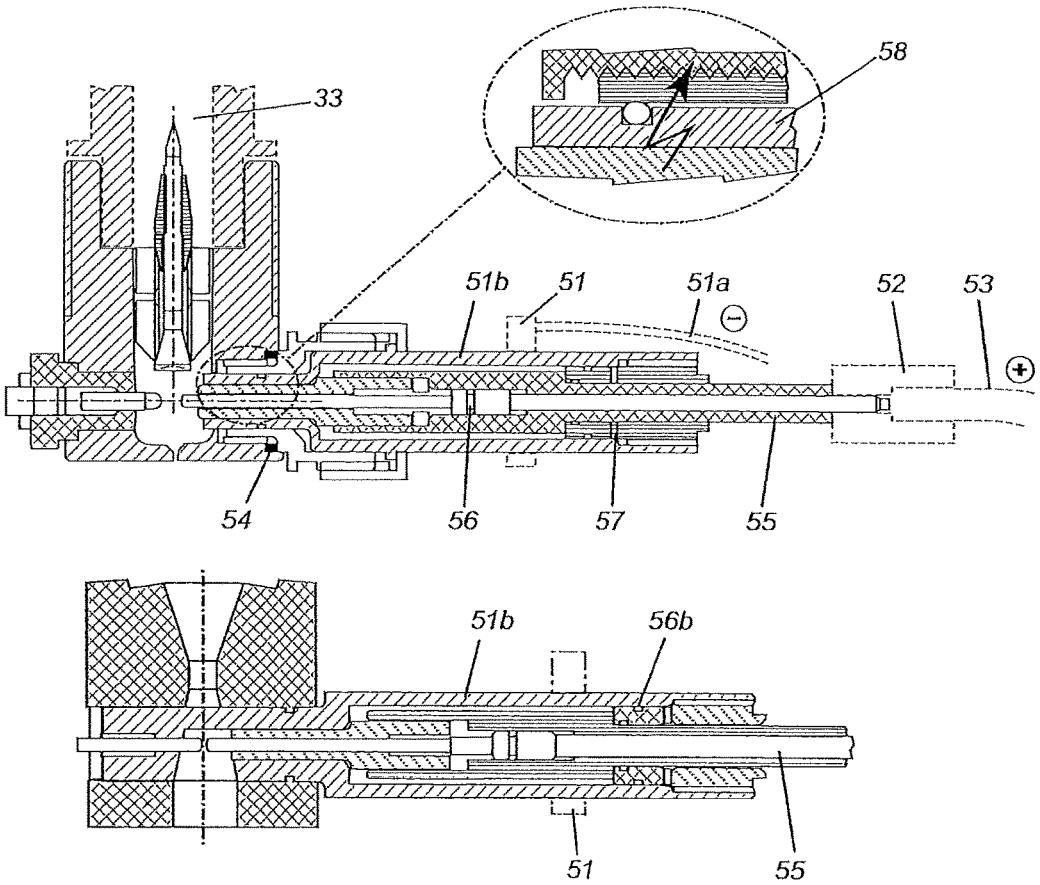
FIG. 16 is yet another embodiment as FIG. 15 showing the possibility of tracking (unwanted sparking) indicated in the inset.

FIG. 16 is the same embodiment as illustrated in FIG. 15 to highlight the precautions to be taken with high voltages (for example, voltages≥5 kV). The two major issues to address for reliability of the electro-discharge technique are: (1) sealing arrangements in all the embodiments and (2) prevention of undesirable sparks, often called tracking, which could destroy the insulating materials used to separate the ground electrode assembly 51 from the high-voltage electrode 55 (described in the Sections on Electrodes) and other materials. All of the illustrated embodiments of this invention require sealing, e.g. special O-rings 54, 56, 56*a*, gaskets 57 and washers or any other fluid-tight sealing means to seal against high transient pressures generated by the shocks and the high transient temperatures generated by the plasma bubble. High strength seals (≈90 durometer), such as Viton or similar O-rings may be used in these embodiments.

For efficient performance, the breakdown of water to form a plasma bubble must happen in the gap between the electrodes. However, the state of the flow (e.g. turbulent flow) and other factors may cause the discharge to take place at other locations, for example from the tip of the high voltage electrode to the inside surface of the nozzle chamber, which will eventually destroy the smooth surface of the nozzle. As illustrated 58, tracking can also occur between the high-voltage electrode stem 55 and inner surface of the ground casing 51*b* leading to the failure of the insulating material. These problems are overcome with the embodiments described below.

Figure 17:
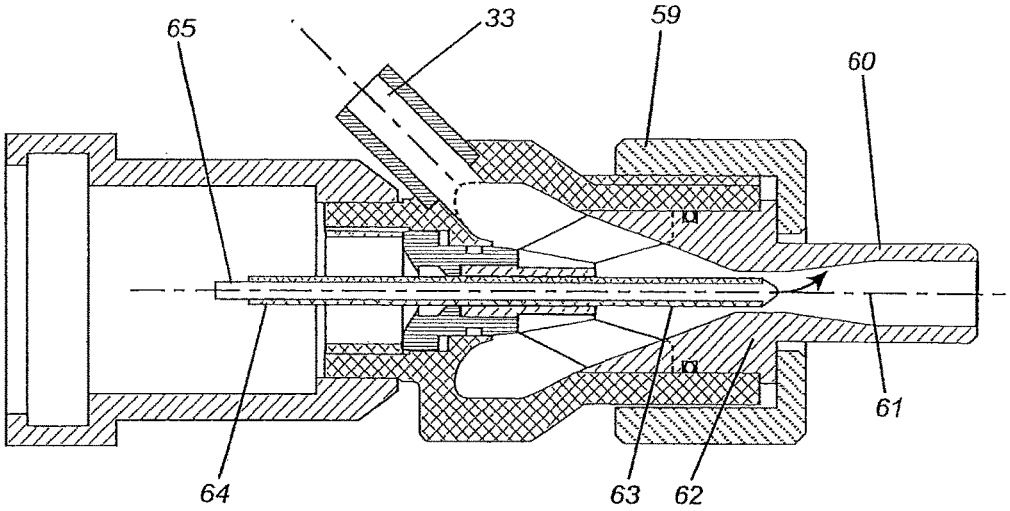
FIG. 17 is another embodiment of a nozzle that may be used for the electro-discharge apparatus.

FIG. 17 shows another embodiment of an electro-discharge nozzle. Water enters through the side port 33, fills the discharge chamber 63 for reducing the speed of the flow and forms a wake downstream of the insulated 64 high-voltage electrode 65. By moving the electrode axially forward and backward, the discharge zone and length of the arc 61 formed by the discharge can be varied, giving rise to a range of plasma bubbles or plane or spherical shockwaves. The nozzle insert 62 is connected to the discharge chamber 63 by the nut 59. The lengths of the diverging sections 60 can be varied from zero to any suitable length (≈10 in).

Figure 18:
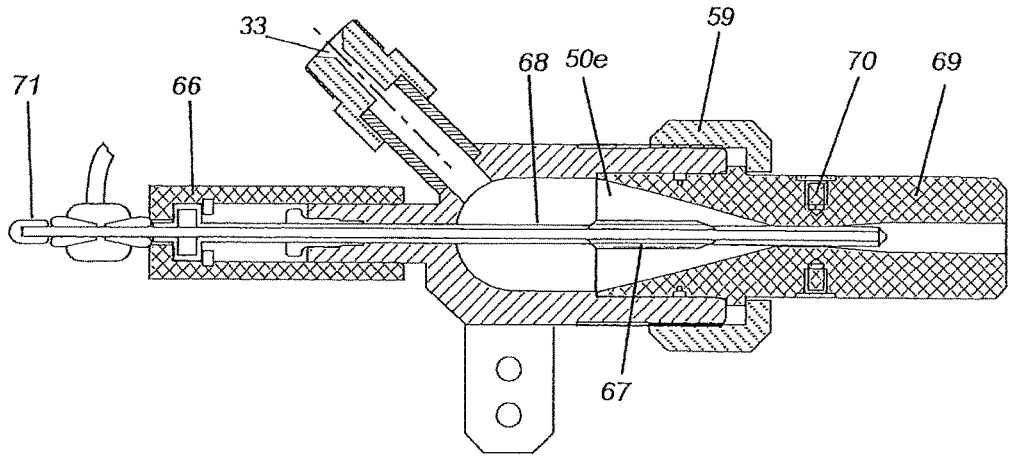
FIG. 18 is an embodiment for improving the alignment of the central electrode in the nozzle.

FIG. 18 shows another embodiment for modulating low water flows (≤2 usgpm/min) at very high pressures (≥20 kpsi). As in the embodiment of FIG. 17, high-pressure water enters through an inlet (side port 33) from the pump. Since low flows are involved, the annular clearance would be of the order of 0.002 in, forming a long wake downstream of the insulated electrode tip 70. The flow straightener 50*e* is mounted on a plastic stub 67 for adjusting its position upstream of the annulus. The axially located high-voltage electrode can be moved forward and backward to vary the gap width (ι) between the tip of the electrode and the inside surface of the grounded 70 nozzle attachment 69. The sleeve 66 fabricated from high-strength plastic holds the other end of the high-voltage electrode for easy movement in the nozzle attachment. The high-voltage cables are connected to the electrode through the adaptor 71. This embodiment produces pulses of water due to implosion of the plasma bubbles.

Figure 19:
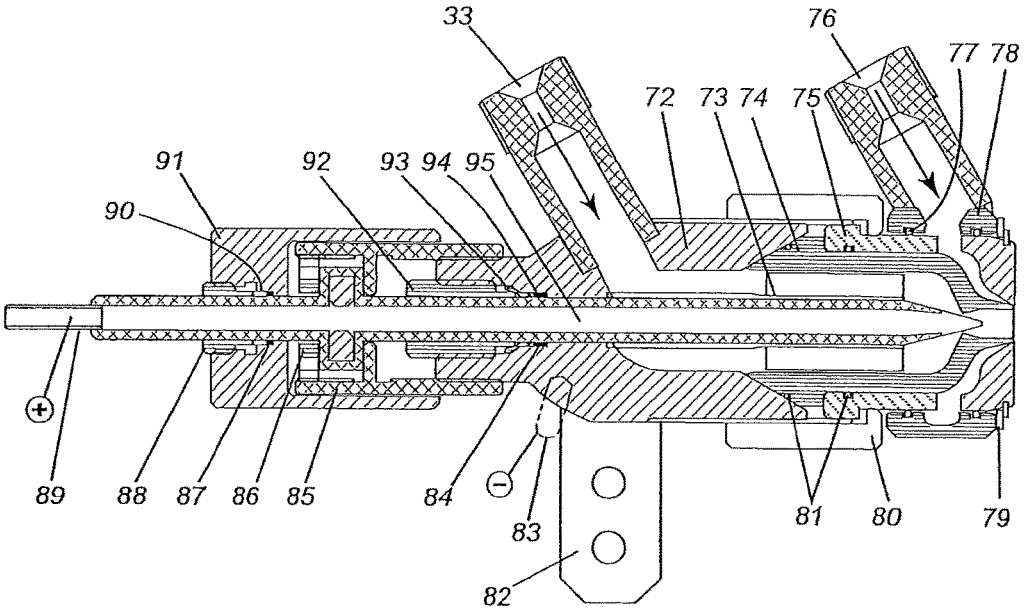
FIG. 19 is an embodiment of a highly complex nozzle configuration to confine the cavitation bubble produced by the electric discharge.

FIG. 19 shows a more complicated design in accordance with another embodiment to confine and focus the cavitation bubble which is, in fact, the plasma bubble when it cools down. In all the embodiments disclosed in this specification a cavitation bubble does indeed form. However, generally as soon as it arrives at the nozzle exit, it has a tendency to ventilate to the atmosphere without doing any useful work. The objective of the embodiment illustrated in FIG. 19 is to confine and focus the highly energetic cavitation bubble onto the target.

In the embodiment depicted in FIG. 19, the apparatus has a main body 72 to which the main nozzle 74 is connected with the nut 80 sealed with the O-rings 81. Water from the pump enters into the main body 72 through the port 33 and flows through the annulus between the electrode and the nozzle exit as indicated by arrows 33*a*. Electrical discharge occurs in this main flow. Water entering the sheathing nozzle 75 through the port 76 emerges as a sheath (annulus) of water around the main jet as indicated by dashed arrows 76*a*. The purpose of this secondary annular jet is to confine and transport the cavitation bubble towards the target to be processed. The port 76 is welded to the ring 78 and sealed with the O-rings 77.

Other components of the apparatus in accordance with this embodiment include an insulated central electrode 95, which is inserted into the guide tube 73 which also acts as a flow straightener (50*f*, FIG. 15) to align it with the nozzle exit, a gland 92, a back-up ring 93, bushing 94, cap for holding the high voltage electrode 91, and another back-up ring 90, another gland 88, locking ring 86 for the electrode, electrode nut 85, stainless steel rod 83 for grounding the main body 72, and the bracket 82 for securing the nozzle-electrode assembly to a gantry or a robotic manipulator, stem of the high-voltage electrode 89 for connection to the high-voltage cables and O-rings 84 and 87 to seal the electrode against leakage of water. Most of the components illustrated in this embodiment also apply to other embodiments.

Figure 20:
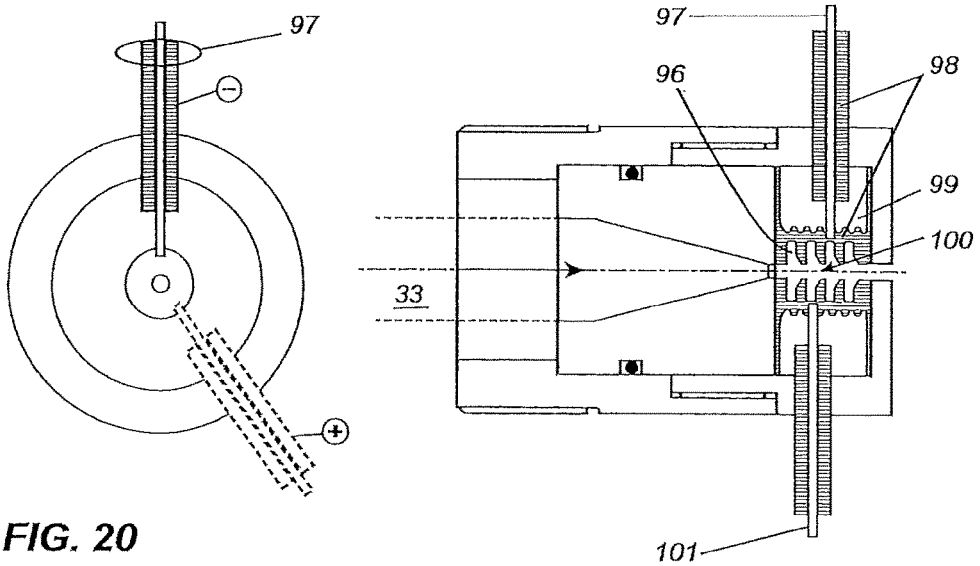
FIG. 20 is an embodiment with the electrode in the nozzle exit for generating sequential discharges.

FIG. 20 depicts an apparatus in accordance with another embodiment that is designed for one or several sequential discharges in the diverging exit section of the nozzle 100.

As the tips of the ring electrodes 96, placed circumferentially, are flush with the inner surface of the diverging section of the nozzle, the flow through the nozzle is quite smooth with no disturbances. The apparatus in accordance with this embodiment is meant for low flows (≈1 usgal/min) at low pressures (≈2 kpsi). The ring electrodes 96, the ground 97 and high voltage stems 101 are encased in silicon rubber 98 as insulating material. For additional safety the ring electrode assembly is embedded in a ceramic plug 99. A pair of electrodes can be fired once as in other embodiments. Or, they can be fired in sequence, over a delay of a few microseconds, to augment the intensity of the shock and plasma and propel them toward the target. This is possible because the line of spark, indicated by the dotted arrow, is in the same direction as the flow.

Figure 21:
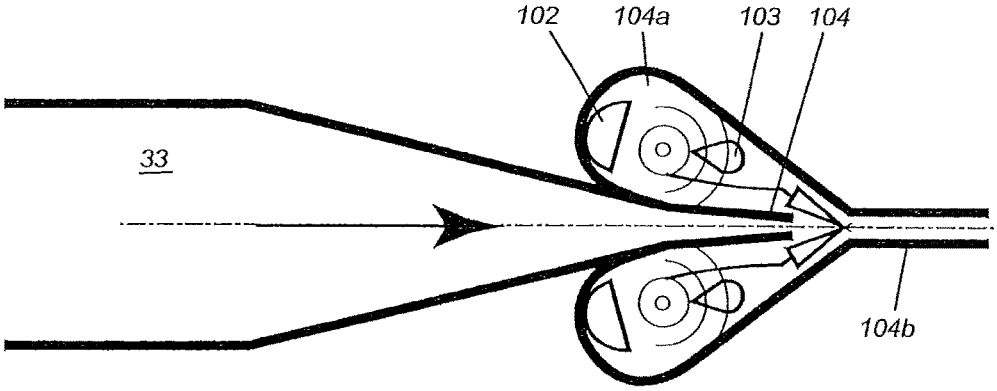
FIG. 21 is a conceptual design to enhance the power of the water pulse by the converging shockwaves.

FIG. 21 shows an apparatus according to yet another embodiment for intensifying the strength of shock waves formed in quiescent water in the nozzle. Theoretically, collision and convergence of two shock waves, indicated by the arrows, would increase the speed of the pulsed jet emerging from the nozzle. Ring-type ground electrodes 102 and ring-type high-voltage electrodes 103 are placed above and below the main nozzle 104. With a check valve, not shown in FIG. 21, the flow through inlet (or port) 33 from the pump or a water bottle, fills the discharge chamber 104*a* and remains momentarily stagnant (quiescent). The expanding spherical shock waves following the plasma channel formation converge at the entry to the nozzle exit 104*b* augmenting the speed of the emerging pulsed waterjet.

Figure 22:
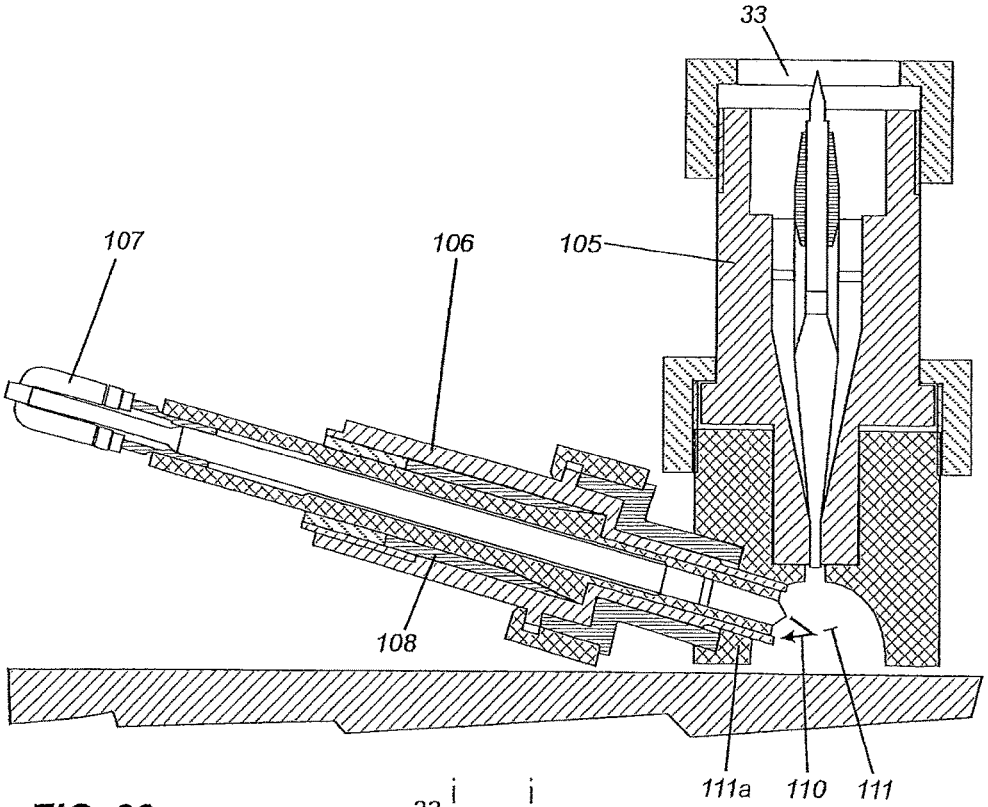
FIG. 22 is an embodiment of a nozzle that can be placed on the target surface.

In the embodiment depicted in FIG. 22, an apparatus is placed right on the surface 109 to be processed, for example, fragmenting the concrete biological shield of a nuclear power system. In this embodiment, the apparatus is basically the same as the embodiments illustrated in FIG. 12 and FIG. 13 with a hemispherical discharge chamber 111 to focus the shock wave, plasma bubble and pulse of water to impact the surface. Water enters through the inlet (or port) 33 into the hemispherical discharge chamber 111 and remains momentarily as quiescent water due to the abutment of the face 111*a* of the discharge chamber 111 against the surface 109. The reflector assembly is placed in the housing 105. The high-voltage electrode 107 and the ground shell 106 are assembled as one unit for easy insertion into the hemispherical discharge chamber 111. The shock absorber 108 fabricated from high-strength elastomers is configured to absorb the high stresses generated by the shock waves. The discharge, as indicated by the arrow 110, takes place between the tip of the high-voltage electrode 107 and the tip of the ground shell 106.

Figure 23:
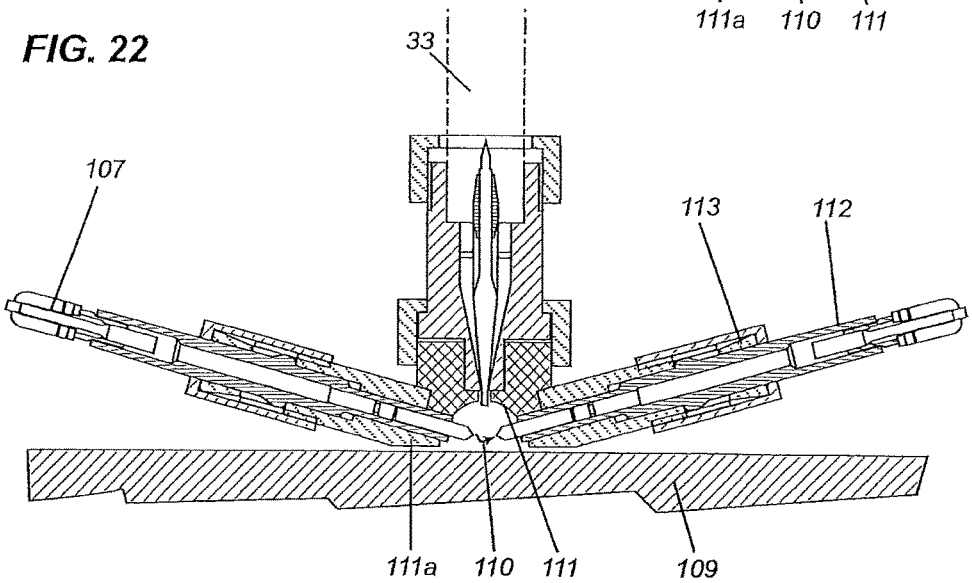
FIG. 23 is an embodiment having two electrodes to produce a short plasma channel close to the target surface.

FIG. 23 shows another embodiment similar to the embodiment depicted in FIG. 22, except it incorporates separate ground 112 and high voltage electrode 107, making it possible to vary the gap width (ι). The speed of the pulsed jet can be increased by increasing ι, forming long plasma channel 110 which enhance the efficacy of the electro-discharge technique for inducing fractures (cracks) or fragmentation of very hard rocklike materials.

Figure 24:
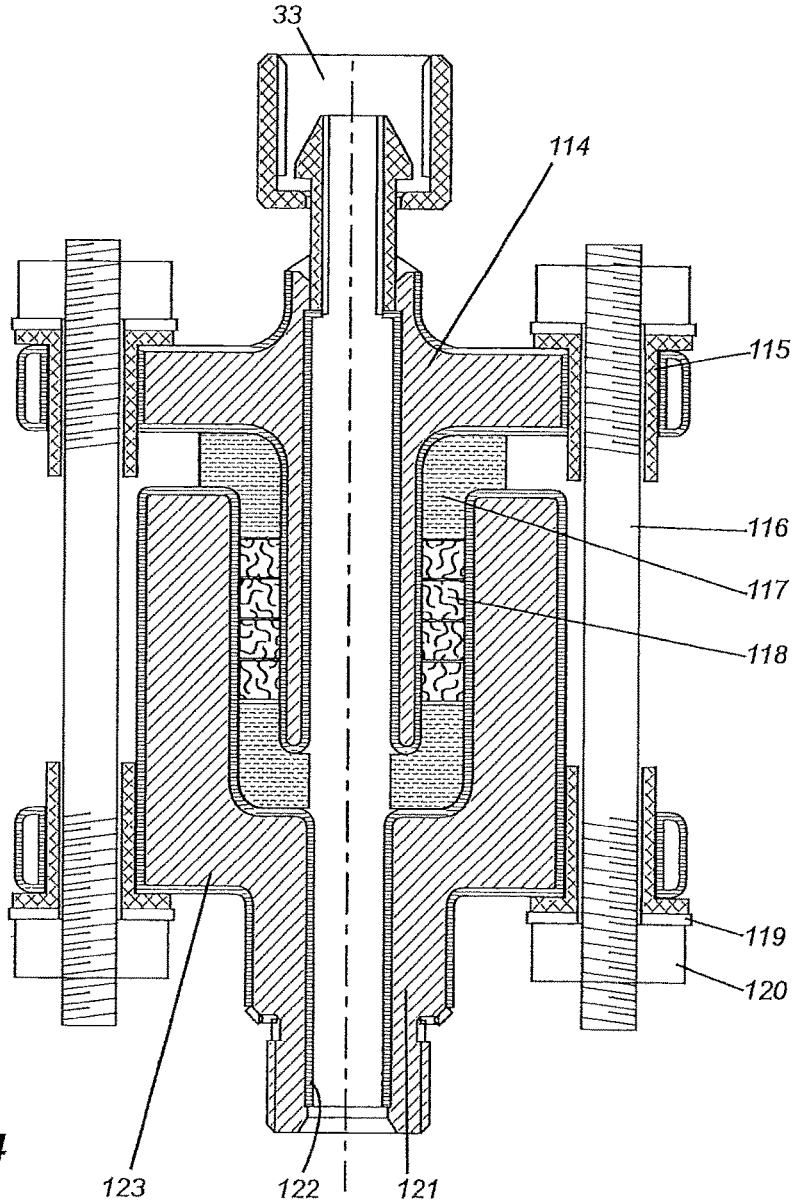
FIG. 24 is a drawing of a coupling to connect the nozzle to a pump.

FIG. 24 shows an embodiment for connecting nozzle electrode assemblies, disclosed in all the previous sections, to the water pump. As is known in the field of high-voltage engineering (T. Croft and W. I. Summers, "American Electricians Handbook," 14$^{th}$ Edition, McGraw Hill, 2002), extreme precautions need to be taken to ensure safety of the personnel and other equipment. In the case of electro-discharge technique, tracking (that is, undesirable sparking) needs to be eliminated by proper grounding of all the components, to the same ground, for example, a water pipe. The other major problem is to prevent the damage of electronic equipment caused by electromagnetic radiation caused by high transient discharge current, by proper shielding of all cables, etc.

In the case of a high-pressure water pump, the hose used generally consists of braided metal wire. Therefore, when the hose is connected to the grounded nozzle, the discharge current can also flow through the hose to the pump and may damage electrical components of the pump. The embodiment shown in FIG. 24 includes an insulated hose coupling to electrically isolate the pump from the nozzle assembly.

The coupling include a metal part 114 for connecting to the nozzle assembly 33 and the high-pressure fitting 121 fabricated from high-strength stainless steel. Both inner and outer surfaces of the metal part 114 and the fitting 121 are coated with epoxy or similar coating 122 as insulation. Sealing package 123 includes a soft packing 118 made from Teflon or similar material, held in place by high-strength plastic material such as glass-PEEK (Polyether ether ketone) 117. The parts are assembled and tightened by threaded studs 116 and nuts 120 with metallic washers 119 and a bushing 115 made from glass-PEEK or similar materials.

Figure 25:
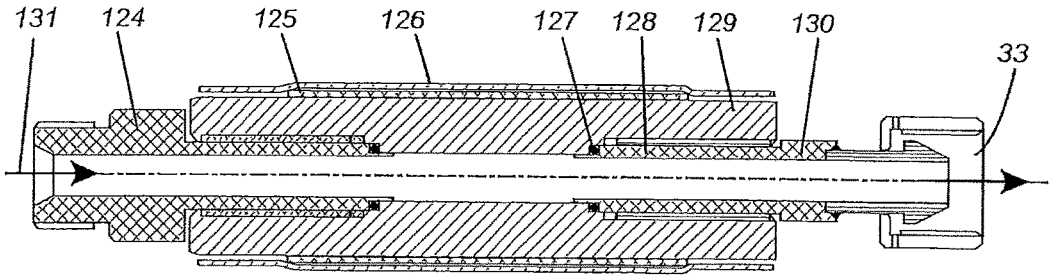
FIG. 25 is yet another embodiment of the coupling to connect the nozzle to the pump.

FIG. 25 shows yet another coupling for connecting the pump to the nozzle assembly to eliminate grounding problems and which is suitable for low pressures (≈5 kpsi). A high-strength threaded 128 plastic insulator 129 is used to connect the high pressure fitting 124 for water flow 131 from the pump and the fitting 130 leading to the nozzle assembly. Water leakage is prevented by the O-rings 127. The plastic body was further reinforced from outside by a thermally shrunk metallic sleeve 125. The whole assembly was enclosed in a flexible plastic tubing 126 to provide additional electrical insulation.

It is quite clear from the descriptions given in all the previous sections that electro-discharge is a complex phenomenon requiring great deal of attention to design of all components to derive its benefits while preventing damage to personnel and other equipment in the vicinity of the electro-discharge apparatus. It is also clear that, depending on the application, it is possible to manufacture a variety of nozzle configurations (chambers) to optimize the performance of the electro-discharge technique. Each type of nozzle configuration requires a different type of high voltage and ground electrode assembly for efficient deposition of electrical energy in the discharge chamber. This requires that the discharge should occur only between the tips of the electrodes and not anywhere else, that is, tracking (unwanted sparking, as illustrated by the bolded arrow 58 in FIG. 16) must be avoided. This is only possible by paying utmost attention to the design of electrode assemblies and how they are connected to the capacitor bank. In the following sections some of the configurations and the main features are disclosed.

Figure 26:
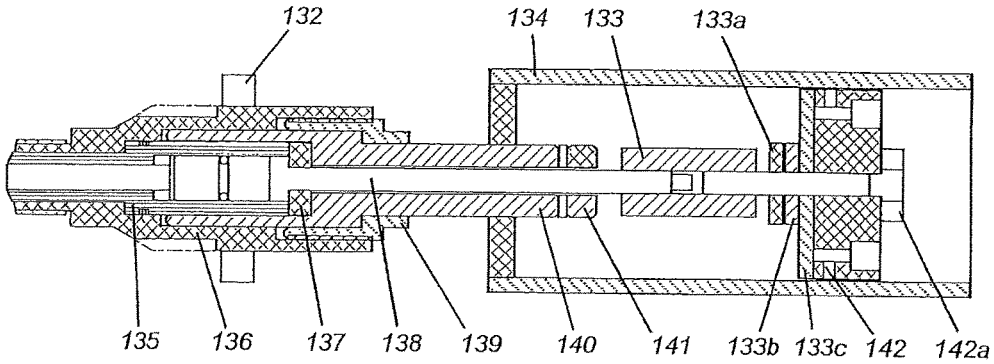
FIG. 26 is an embodiment of the high-voltage electrode and the adaptor to connect it to cables from a capacitor bank.

FIG. 26 shows one embodiment of the electrode assembly and a component to connect it to the cables from the capacitor bank. This embodiment is meant for the nozzles of the type illustrated in FIG. 12 and FIG. 13 or similar types. The assembly shows the main body 136 fabricated from stainless steel or similar material connected to the ground bus bar 132. The central high-voltage electrode 138, fabricated from tungsten carbide or similar wear-resistant material, is insulated from the grounded main body by the coaxial tubes 135 and 140 fabricated from high dielectric strength plastic materials such as Ultem™, PEEK or similar materials. The high-voltage electrode is secured by the main nut 139 made from stainless steel, and the lock nut 137 made from brass or bronze or similar soft metal and the nut 141. The high-voltage stem 138 is connected to the high-voltage bus bar assembly 142 of high-voltage cables by the coupling 133 made from brass, copper or similar highly conducting metals. The high-voltage bus bar is assembled by the stud 142*a*, the plastic nut 133*a*, plastic washer 133*b* and the plastic disc 133*c*. The high-voltage cables are secured by the set screws. For additional safety, the high-voltage bus bar assembly is enclosed in a plastic tube 134 made from acrylic or similar material.

Figure 27:
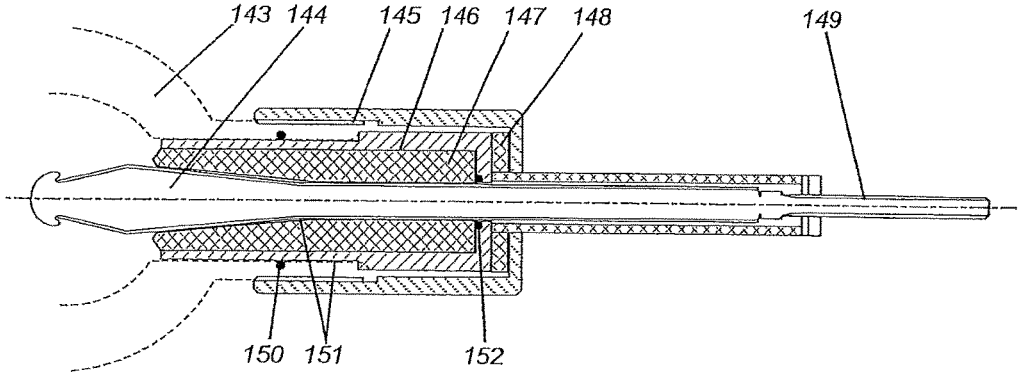
FIG. 27 is another embodiment of the electrode to withstand the high-strength shockwaves produced by the discharge.

FIG. 27 is another embodiment of an electrode assembly 143 for the nozzle configuration illustrated in FIG. 10 or similar types. The electrode configuration is meant for high static pressure of water (≈20 kpsi) and also high shock loading following the discharge. The front 144 of the high voltage stem 149 is shaped in the form of diverging and converging conical portions for self-sealing. As shown in this embodiment, the tip is a bulbous tip with the converging cone meeting a rear face of the tip to provide an angled annular lip. The entire rod is coated with epoxy 151 or any similar material, capable of withstanding high voltages up to a maximum of 50 kV and which is compatible with water. The high-voltage electrode 149 is inserted into two metallic sleeves 146 and 147 the outer surfaces of which are also coated with epoxy or similar high dielectric strength materials and are glued together with Loctite™ or similar adhesive. The electrode assembly is connected to the grounded nozzle body with the nut 145, making provision for changing the gap width (ι) by varying the thicknesses of the washers 148. Leakage of water is prevented by the O-rings 150 and 152.

Figure 28:
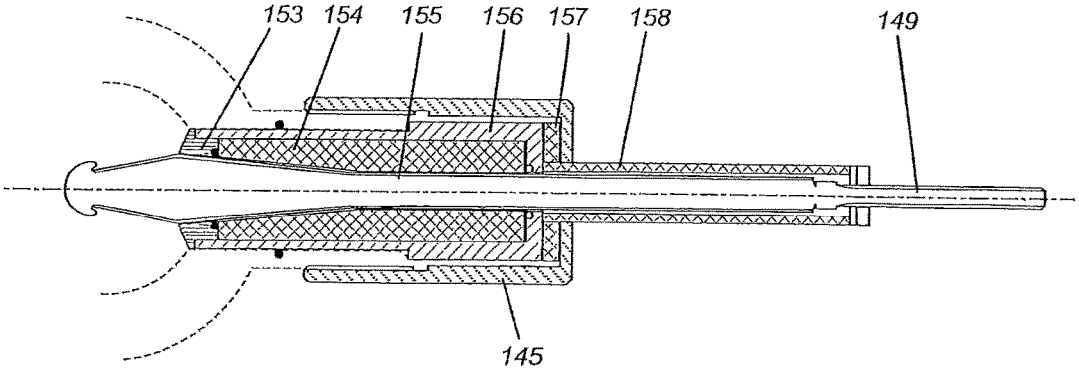
FIG. 28 is yet another embodiment of the high-voltage electrode.

FIG. 28 is yet another embodiment for use in the nozzle body shown in FIG. 10 or similar types. The electrode assembly has the same configuration as shown in FIG. 27 with slight modifications to eliminate tracking (undesirable sparking) between the high-voltage electrode 149 and the grounded nut 145. The coated high-voltage electrode 155 is surrounded by the inner sleeve 154 fabricated from high-strength plastic PEEK or similar material, which is inserted in the metallic sleeve 156, the inside surface of which is coated with epoxy or similar materials. The electrode assembly is protected by the ring 153 fabricated from soft metal or elastomers. The gap width (ι) can be varied by the washers 157. Plastic tubing 158 surrounding the rear portion of the electrode 155 prevents any tracking from the electrode to the washer.

Figure 29:
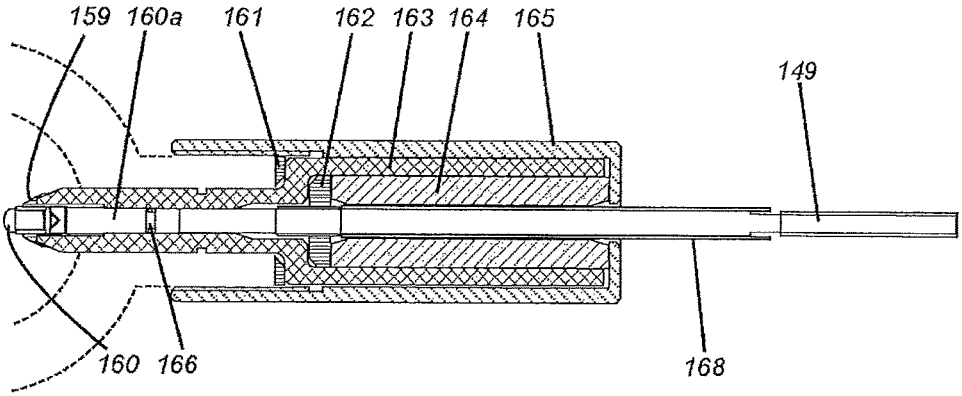
FIG. 29 is yet another embodiment of the electrode.

FIG. 29 shows an embodiment of the electrode assembly for the nozzle configuration illustrated in FIG. 12 or similar types. The high-voltage electrode 149 is insulated from the grounded nut 165 by two plastic sleeves 163 and 164 which may be made from Ultem™ resin, PEEK-glass or similar materials. As plastic materials are generally brittle, the sleeves are kept under compression by the nut 162 made from bronze or similar material and the metallic protector 159 made from stainless steel or similar material. The protector is glued or bonded to the sleeve 163 by a strong adhesive, such as Loctite™ or similar adhesive. The gap (ι) between the electrodes can be varied by using the spacing rings 161 made from Lexan or similar materials. Sealing is achieved by the hard Parker O-rings 166 and 167. The tip 160 made from tungsten copper or similar material is silver soldered to the front 160*a* of the high-voltage stem 149. For additional protection the high-voltage stem 149 is inserted into a tubing, e.g. a Tygon® tubing 168.

Figure 30:
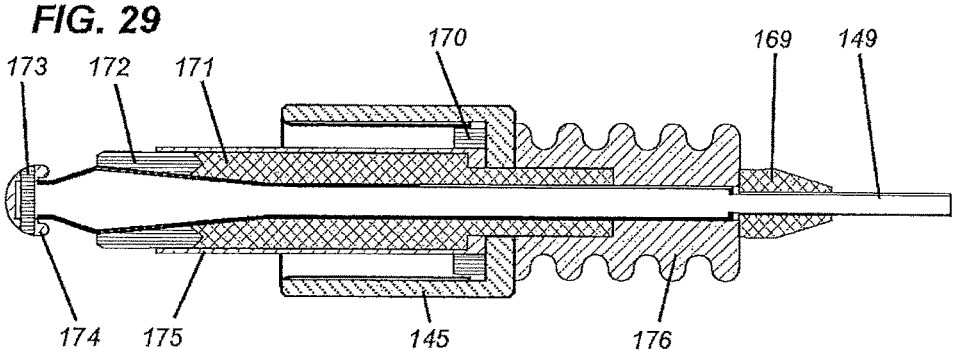
FIG. 30 is yet another embodiment of the electrode assembly.

FIG. 30 depicts yet another embodiment of an electrode assembly for use in the nozzle body shown in FIG. 10 or similar types. It is similar to the electrode assemblies depicted in FIG. 27 and FIG. 28 with some additional novel and safety features. The high-voltage electrode 149 includes the tip 174 which is held in place by a pin 173. When the tip 174 wears off due to ablation caused by the sparks, a new one can be easily inserted to continue the operations where repeated discharges are required. The sleeve surrounding the electrode includes a central insulator 171 made from PEEK or similar material and the front insulator 172 made from elastomers to absorb the shock loads caused by the discharge. The assembly of the electrode and the sleeves are glued to the coated outer metallic sleeve 175. The assembly is inserted into the nozzle housing 143 and tightened by the grounded nut 145. The gap width (ι) can be varied by the washers 170. In order to prevent tracking between the rear part of the nut 145 and the high-voltage cable connector 169 or the stem 149, an insulator 176, similar to the undulating or sinusoidal shape used in high-voltage transmission lines, is inserted as shown.

Figure 31:
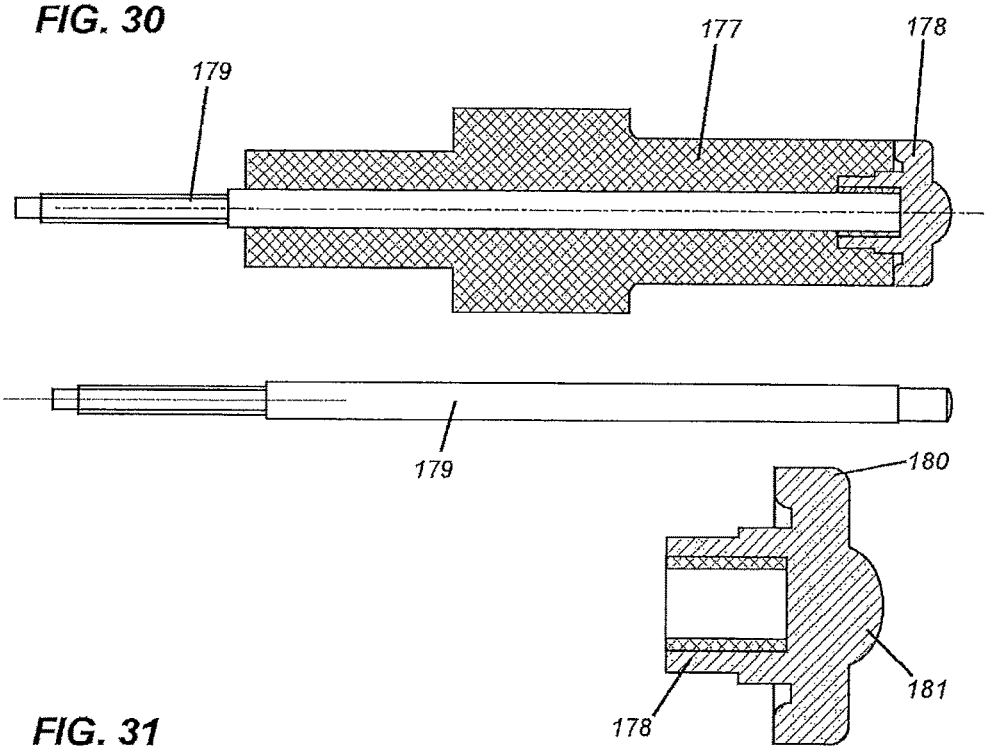
FIG. 31 is an embodiment showing a detailed drawing of the insulating material surrounding the high-voltage electrode.

FIG. 31 illustrates a high-voltage electrode assembly according to another embodiment that can be used for any nozzle configuration for moderate operating pressures (≈40 kpsi) and voltages up to 20 kV. The tip 178 is threaded to the high-voltage stem 179. In order to prevent tracking between the tip 181 and at any location on the inside surface of the nozzle body, the shoulder 180 is coated with a high-dielectric-strength plasma coating such as aluminum oxide or a similar material. The high-voltage stem 179, except the threaded part, is also coated with the plasma coating. The curved, hemispherical or any other shape part of the tip 181 can be coated with high ablation resistant metal, such as an alloy of tungsten carbide, chromium and cobalt or similar components, to prolong the life of the electrode. The stem itself can be fabricated from inexpensive metals such as brass or copper. As the tip wears off, a new tip can be easily connected to the threaded electrode stem reducing the downtime. The coated electrode stem is enclosed in a sleeve 177 fabricated from high-strength plastic or a metal coated on all sides with an insulating material same as the shoulder 180, using plasma or any other coating technique.

It is believed that the pressure created by the impact of the water jet produced by some embodiments is approximately 765,000 $N/m^2$ whereas the pressure required for activating the landmine pressure plate is approximately 105,000 $N/m^2$. Therefore, the pressure created by the water jet in some embodiments is well sufficient to detonate the landmine.

The embodiments of the invention described above are intended to be exemplary only. As will be appreciated by those of ordinary skill in the art, to whom this specification is addressed, many variations can be made to the embodiments present herein without departing from the scope of the invention. The scope of the exclusive right sought by the applicant is therefore intended to be limited solely by the appended claims.

It is to be understood that the singular forms "a", "an" and "the" include plural referents unless the context clearly dictates otherwise. Thus, for example, reference to "a device" includes reference to one or more of such devices, i.e. that there is at least one device. The terms "comprising", "having", "including", "entailing" and "containing" are to be construed as open-ended terms (i.e., meaning "including, but not limited to,") unless otherwise noted. All methods described herein can be performed in any suitable order unless otherwise indicated herein or otherwise clearly contradicted by context. The use of examples or exemplary language (e.g., "such as") is intended merely to better illustrate or describe embodiments of the invention and is not intended to limit the scope of the invention unless otherwise claimed.

While several embodiments have been provided in the present disclosure, it should be understood that the disclosed systems and methods might be embodied in many other specific forms without departing from the scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the scope disclosed herein.

The invention claimed is:

1. A landmine-neutralization system comprising:

a vehicle including a water supply tank and an electrical power supply;

an electro-discharge apparatus carried by the vehicle, the electro-discharge apparatus comprising one or more electro-discharge nozzles that generate a plasma bubble which expands to form a shockwave to neutralize a landmine buried in the ground; and a support arm extending from the vehicle for supporting the electro-discharge apparatus above the ground, wherein the support arm is adjustable to adjust a height of the electro-discharge apparatus above the ground.

2. The system as claimed in claim 1 further comprising a ground-sensing device to measure a distance to the ground.

3. The system as claimed in claim 2 further comprising a controller to automatically adjust the height of the electro-discharge apparatus based on the distance measured by the ground-sensing device.

4. The system as claimed in claim 3 wherein the ground-sensing device comprises SONAR.

5. The system as claimed in claim 3 wherein the ground-sensing device comprises ultrasound.

6. The system as claimed in claim 1 wherein the support arm is further configured to tilt the electro-discharge apparatus.

7. The system as claimed in claim 6 wherein the electro-discharge apparatus comprises a plurality of nozzles and a plurality of orifices.

8. The system as claimed in claim 7 further comprising a mine-detecting sensor.

9. The system as claimed in claim 8 wherein the mine-detector sensor is mounted to the electro-discharge apparatus.

10. The system as claimed in claim 9 wherein the mine-detector sensor is retractable within the electro-discharge apparatus.

11. The system as claimed in claim 10 comprising an actuator for extending and retracting the mine-detecting sensor.

12. The system as claimed in claim 11 further comprising a blast door to protect the sensor.

13. The system as claimed in claim 12 wherein the blast door is a pivoting blast door.

14. The system as claimed in claim 12 further comprising a door sensor to sense when the door is closed.

15. The system as claimed in claim 14 comprising a switch to trigger the electro-discharge apparatus, and wherein the blast door must be closed before the switch can be triggered.

16. The system as claimed in claim 14 comprising a switch to trigger the electro-discharge apparatus, and wherein triggering the switch causes the blast door to close.

17. The system as claimed in claim 1 wherein the vehicle is an autonomous robotic land vehicle.

18. A landmine-neutralization system comprising:

a water supply tank and an electrical power supply;

an electro-discharge apparatus comprising one or more electro-discharge nozzles that generate a plasma bubble which expands to form a shockwave to neutralize a landmine buried in the ground; and a support arm for supporting the electro-discharge apparatus above the ground, wherein the support arm is adjustable to adjust a height of the electro-discharge apparatus above the ground.

19. The system as claimed in claim 18 further comprising a ground-sensing device to measure a distance to the ground.

20. The system as claimed in claim 19 further comprising a controller to automatically adjust the height of the electro-discharge apparatus based on the distance measured by the ground-sensing device.

* * * * *